United States Patent [19]

Pittasch

[11] 4,099,293

[45] Jul. 11, 1978

[54] CABINET HINGE

[75] Inventor: Willi Pittasch, Herford, Westf., Fed. Rep. of Germany

[73] Assignee: Firma Richard Heinze, Fed. Rep. of Germany

[21] Appl. No.: 746,938

[22] Filed: Dec. 2, 1976

[30] Foreign Application Priority Data

| | | | |
|---|---|---|---|
| Dec. 2, 1975 | [DE] | Fed. Rep. of Germany | 2554129 |
| Dec. 2, 1975 | [DE] | Fed. Rep. of Germany | 2554130 |
| Dec. 2, 1975 | [DE] | Fed. Rep. of Germany | 2554133 |
| Jun. 3, 1976 | [DE] | Fed. Rep. of Germany | 2624841 |

[51] Int. Cl.[2] ..... E05D 7/12

[52] U.S. Cl. ..... 16/149; 16/159; 16/163; 16/164; 16/168; 16/171; 403/322

[58] Field of Search ..... 16/131, 129, 149, 158, 16/159, 163, 164, 168, 171; 403/322, 316, 330, 361

[56] References Cited

U.S. PATENT DOCUMENTS

| | | | |
|---|---|---|---|
| 574,636 | 1/1897 | Slack | 16/149 |
| 1,536,490 | 5/1925 | Geschickter | 16/149 |
| 3,853,416 | 12/1974 | Hanan | 403/322 |
| 3,977,043 | 8/1976 | Zernig | 16/149 |
| 4,009,507 | 3/1977 | Lascarrou | 16/149 X |

FOREIGN PATENT DOCUMENTS

| | | | |
|---|---|---|---|
| 189,961 | 5/1957 | Austria | 16/171 |
| 2,322,258 | 11/1973 | Fed. Rep. of Germany | 16/171 |
| 2,102,278 | 8/1972 | Fed. Rep. of Germany | 16/168 |

*Primary Examiner*—James Kee Chi

*Attorney, Agent, or Firm*—Jacobs & Jacobs

[57] ABSTRACT

The present invention relates to a cabinet hinge for pivotally connecting two cabinet parts, and particularly for pivoting a cabinet door to a cabinet body, the hinge having a first hinge part adapted to be attached to the first cabinet part and having a second hinge part which is adapted to be connected to the second cabinet part and bears, pivoted to it, a hinge arm which can be locked in a recess of the first hinge part, preferably by the engagement of at least one locking element. The first hinge part of this hinge is a body which can be anchored in a borehole of the first cabinet part and has a recess to receive the hinge arm or tang the first hinge part being held displaceably and adjustably in the direction perpendicular to the surface of the first cabinet part, preferably in a recess of an intermediate body of, for instance, bushing-shaped development. The bushing-shaped intermediate body is, in this connection, anchored in the borehole of the first cabinet part. The hinge may have either a single hinge pin or several hinge pins, for instance four hinge pins.

23 Claims, 41 Drawing Figures

A
1
2
3
4
5
7
10
12
13
14
15
16
17
18
19
20
24
26
31
39
40

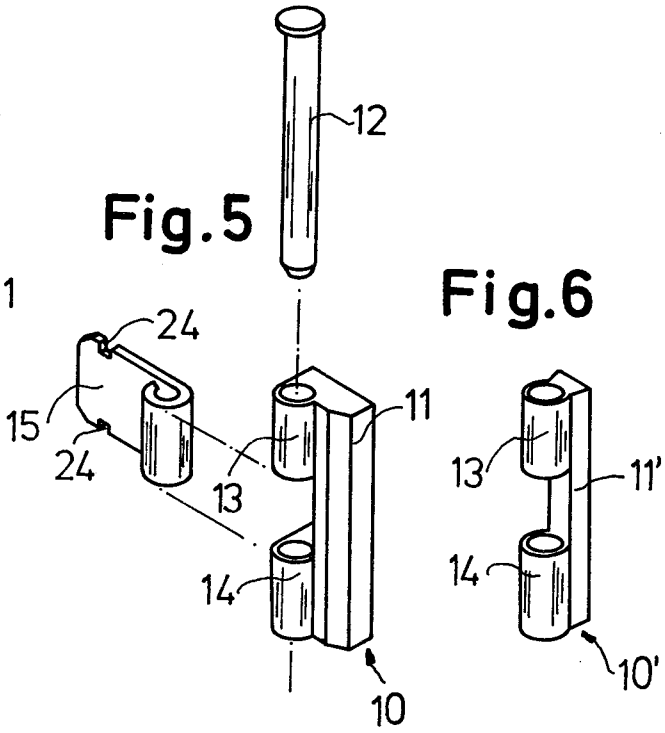
Fig.6
Fig.5
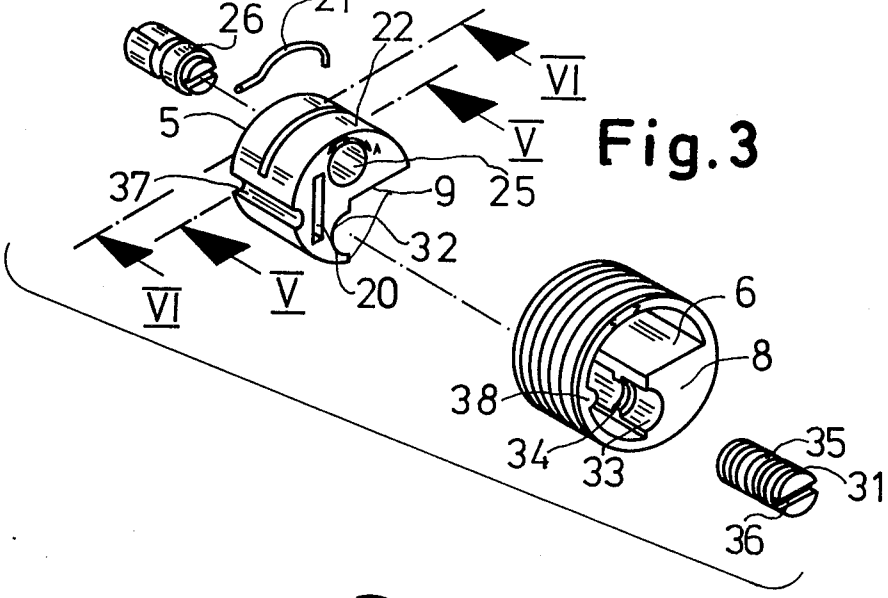
Fig.3
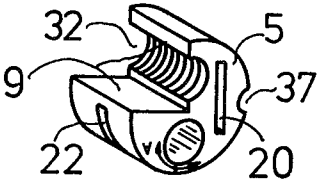
Fig.4

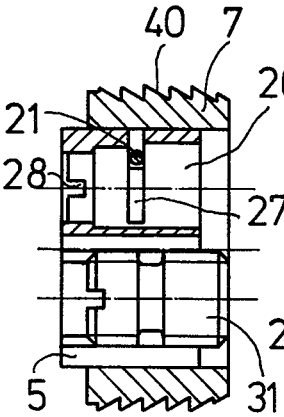
I-I
Fig.9b
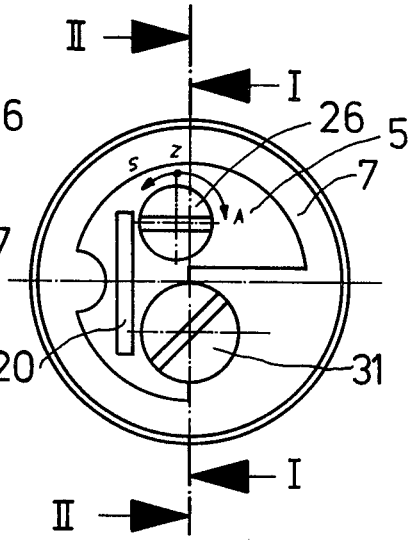
Fig.9a
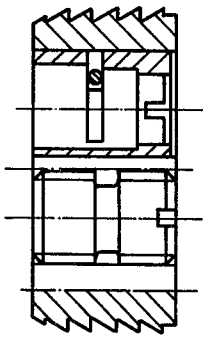
II-II
Fig.9c
Fig. 10.d
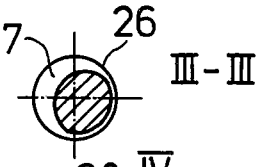
Fig. 10.a
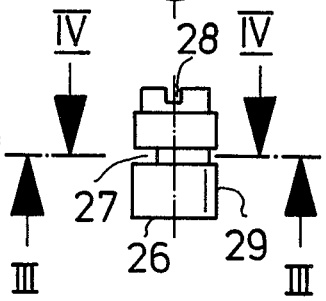
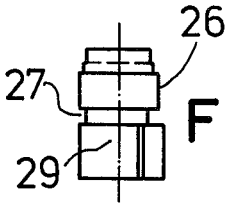
Fig.10.b
Fig.10c
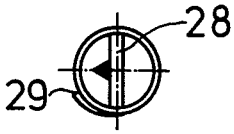
Fig.10e
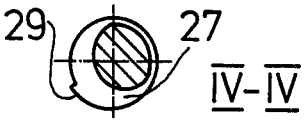

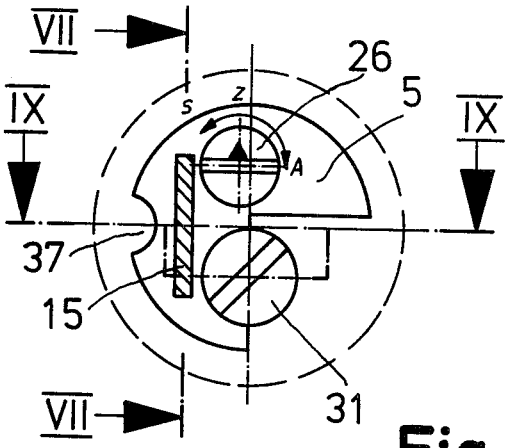
Fig.11
Fig.12
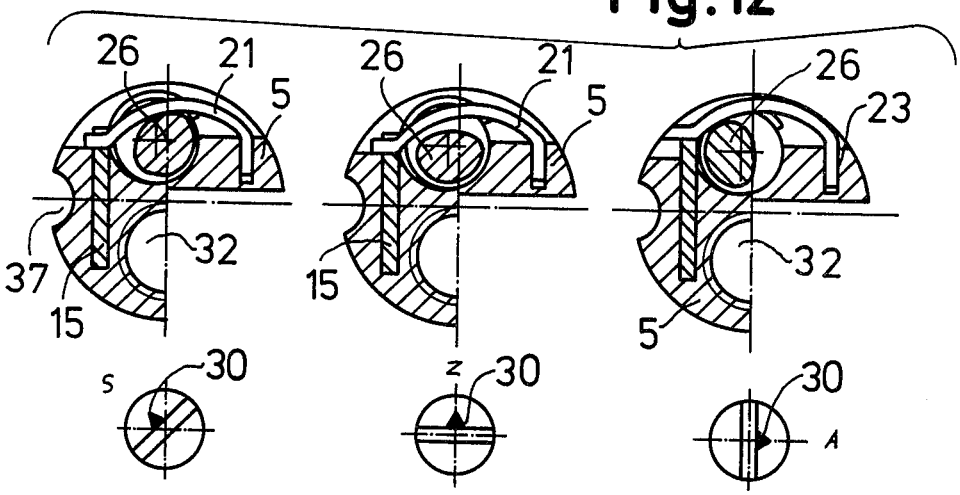
V-V
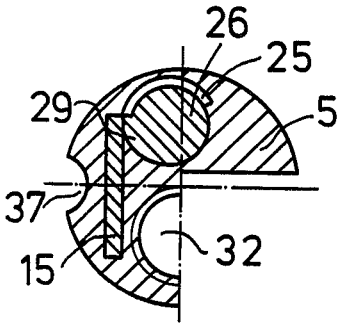
Fig.13

105'
129
105
32
107
106
108
33
34
142
35
31
36
124
125
109
32
105
126
123
131
130
128
115
118
112
113
114
116
122
111
117
110
103
d
121
120
119
102
102

Fig.24a
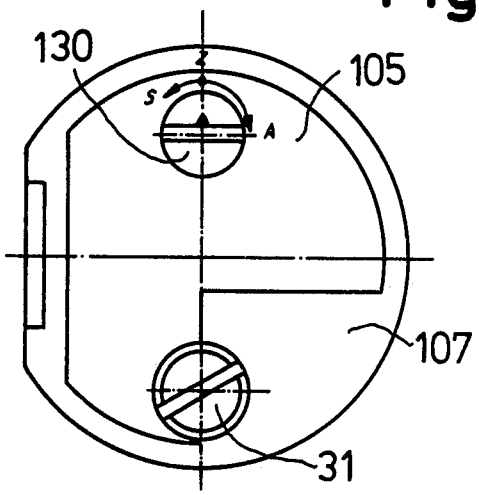
Fig.24b
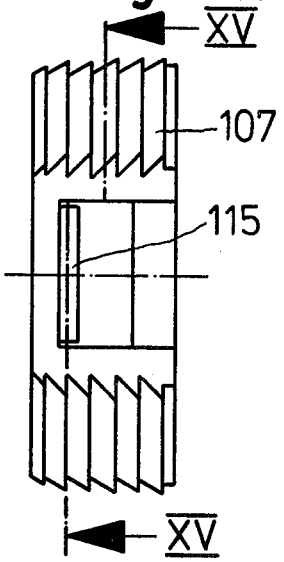
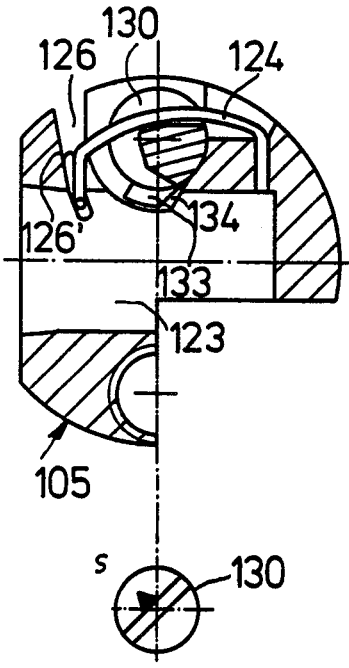
Fig. 25a
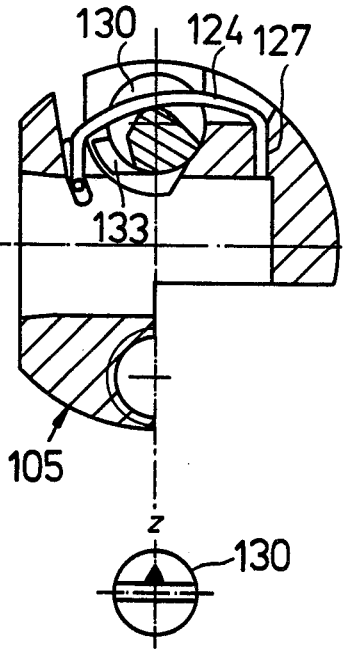
Fig .25b
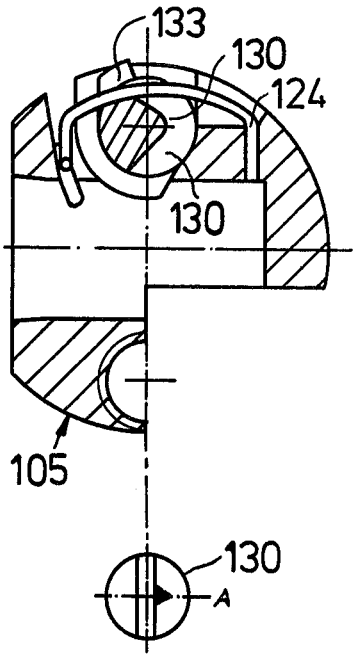
Fig.25c 105
105'
129
246
32
247
246
125
109
124
130
131
132
133
129
123
105
105'
106
108
107
35
31
36
33
34
142
248
221'
219
219'
218'
218
115
128
221
222
220
217'
217
213
214'
214
212
211
210
243
102

CABINET HINGE

DETAILED DESCRIPTION

The present invention relates to a cabinet hinge for the pivoted connecting of two cabinet parts, and particularly for pivoting a cabinet door to a cabinet, it having a first hinge part adapted to be attached to the one part of the cabinet and a second hinge part which is adapted to be connected to the second part of the cabinet and has a pivoted hinge arm which can be locked in a recess of the first hinge part, preferably by the engagement of at least one locking element.

Cabinet hinges are known in a large number of types. The known hinges, however, are relatively expensive to manufacture and are not suitable for the efficient manufacture of cabinets, particularly when the machines and equipment at present used in the cabinet industry are to be used for mounting hinge parts on the cabinet parts, for instance on the side wall of a cabinet and a cabinet door.

The object of the present invention is to avoid this disadvantage and to provide a cabinet hinge which can be mounted rapidly, is of simple construction, and can be mounted by the equipment already available at the cabinet manufacturer's. Furthermore, the hinge of the present invention is adapted to permit the technically unskilled final user to assemble the cabinet parts rapidly and in reliable manner (pivoting of the cabinet door to the body of the cabinet) and, in addition, to permit adjustment of the cabinet door in just as simple and reliable a manner. Furthermore, the cabinet hinge of the present invention is intended to permit simple and uncomplicated removal (for example on moving). The hinge is to be functional and esthetically attractive in its development, i.e. in particular protruding parts and disturbingly visible parts are to be avoided. Furthermore the hinge is to operate without defect or maintenance for a long period of time, even under heavy load.

In order to achieve this purpose, a cabinet hinge of the type described above is developed in accordance with the invention in the manner that the first hinge part is a body which can be anchored in a bore hole in the first cabinet part and has a recess to receive the hinge arm or tang.

The hinge of the present invention is suitable both for the attachment of recessed cabinet doors, i.e. cabinet doors which upon being closed swing into an opening defined by the side walls of the cabinet and the bottom and the top of the cabinet, as well as for attachment of front or full cabinet doors, i.e. cabinet doors which when closed, rest against the end surface of a cabinet body and a cabinet side wall.

The hinge parts of the hinge in accordance with the invention can be premounted on the side wall of a cabinet and the cabinet door by the cabinet manufacturer so that the cabinet manufacturer can furthermore deliver the cabinet in disassembled state to the final consumer in order to reduce transportation space, and the furniture door can be fastened by the final consumer, even laymen, by simply inserting the hinge arm or tang into the recess of the first hinge part on the completely assembled cabinet in particularly simple fashion. Furthermore, with the hinge in accordance with the invention, assurance is had that at least the hinge parts which are premounted by the cabinet manufacturer on the side wall or the body of the cabinet do not protrude in disturbing fashion beyond the plane of the said cabinet side wall, so that damage to the cabinets by protruding hinge parts on the side walls of the cabinet during transportation is avoided.

In one preferred embodiment of the hinge in accordance with the invention, the first hinge part is held in a recess in a preferably bushing-shaped intermediate body anchored in the bore hole of the first part of the cabinet in such a manner that said first hinge part can be displaced and adjusted in the direction perpendicular to the surface of the first hinge part, thus providing a particularly convenient possibility of adjusting the hinge part relative to the cabinet in the direction perpendicular to the attachment surface and in particular perpendicular to the surface sides and the inner side of the side wall of the cabinet.

The first hinge part in this connection preferably has in cross section the shape of part of a circle and is guided in a suitable recess, also having the cross section of part of a circle, in the intermediate body, as a result of which a form-locked connection is obtained between the first part of the hinge and the intermediate body in such a manner that the two parts cannot be turned with respect to each other. The adjusting of the first hinge part relative to the intermediate body is effected by means of an adjustment screw which is preferably developed as a headless screw and lies in a bore hole which is provided on a contact surface between the first hinge part and the intermediate body and is formed by a recess having the shape of part of a circle in the first hinge part and a recess having the shape of part of a circle in the intermediate body, which recesses then supplement each other to form the bore hole for the adjustment screw. The external thread of the adjustment screw engages in this connection into a threaded section in one of these recesses having the shape of part of a circle and is held undisplaceably in axial direction in the other recess having the shape of part of a circle.

The anchoring of the hinge arm in the recess in the first hinge part is preferably effected by means of a detent element which engages, for instance, into a groove or depression in the hinge arm. In order to actuate the detent element there may also be provided an unlocking and locking element which, upon suitable actuation, brings the detent element into engagement with the hinge arm or out of engagement with it so that the hinge arm and, together with it, the second part of the cabinet, for instance the cabinet door, can if necessary at any time be detached again from the first cabinet part, for example from the body or a side wall of the cabinet. The unlocking and locking element is preferably furthermore developed in such a way that in a given position it effects an additional clamping of the hinge arm in the recess in the first hinge part.

Particularly for the attachment of recessed cabinet doors, the, for instance, slot-shaped recess for the hinge arm in the first hinge part extends in the direction perpendicular to the fastening surface of the first hinge part or in the direction perpendicular to the inner surface of the body or side wall of the cabinet. However, other solutions are also possible. Thus, for instance, the recess may extend oblique to said fastening surface or else parallel to the fastening surface, the possibility being present in the latter case of simple adjustment of the hinge arm in a second direction in space, namely in the direction parallel to the surface sides of the body or side wall of the cabinet, by introducing and anchoring the hinge arm to a greater or lesser depth in the recess. In this case, the hinge arm preferably has several depressions or grooves into which the detent element can alternatively engage, depending on the desired adjustment.

The hinge arm is preferably stamped out of a flat metal strip, i.e. it has a rectangular cross section and its larger surface sides are parallel to the pivot pins or pins of the hinge. Metal and/or plastic are suitable for the manufacture of the other hinge parts, provided that plastic is permitted by the forces which occur upon the attaching of a cabinet door.

The hinge in accordance with the invention may have merely a single hinge pin, which then pivotally connects the hinge arm with the second hinge part, or else this pivoted connection can be effected by a so-called four-bar system which has four hinge pins and two hinge levers, each of which pivoted at one end to a hinge pin on the hinge arm and on the second hinge part respectively. This hinge in accordance with the invention which is developed with four hinge pins and two hinge levers is then particularly suitable for the attachment of front cabinet doors, the recess for the hinge arm in the first hinge part in this case also preferably extending parallel to and obliquely to the fastening surface of the first hinge part and to the inner surface of the cabinet or the cabinet side wall respectively, so as to obtain the above-described possibilities of adjustment in two directions in space in order to compensate for manufacturing tolerances, both in connection with the manufacture of the hinge and upon the application of this hinge to the cabinet parts.

The attachment of the hinge arm to the second hinge part is effected, for instance, by a hinge pin provided in said second hinge part, the hinge arm then having a bearing part provided with a bearing opening to receive the hinge pin. On this bearing part there is provided a first slide surface having the shape of a circle or part of a circle, which extends preferably concentric to the hinge pin and with which there is associated at least one second slide surface on the second hinge part, a laterally open slot which extends into the bearing opening being provided in the bearing part outside the first slide surface.

In this way there are obtained particularly simple manufacture and particularly simple mounting for the second hinge part provided with the hinge arm, since the hinge arm together with its bearing part can be pushed, upon mounting, over the hinge pin and then be secured against unintentional dropping out of the second hinge part by a slight swinging of the bearing part or of the hinge arm around the hinge pin.

In one preferred embodiment of this modification of the hinge in accordance with the invention, the second hinge part consists of a section which extends in the direction of the pivot axis or hinge pin, which section is preferably provided at each of its two ends with a laterally protruding extension, each extension having a bearing hole for the hinge pin and the surface side of the section facing the extensions having the second slide surface. In order to introduce the hinge pin there is provided preferably in the second hinge part a slot which extends into the bearing bore holes of the extensions and extends parallel to the line connecting said bearing holes, a second slide surface being provided on at least one longitudinal side of said slot. By this second slot the attachment of the hinge pin in the second hinge part is substantially simplified since with the bearing holes developed as blind holes the hinge pin is anchored by the bearing part of the hinge arm fastened to said hinge pin in the second hinge part, without further means being necessary for this. Furthermore, as a result of the second slot, the manufacture of the second hinge part is substantially simplified, since the bearing holes, which represent practically an extension or a part of the slot, can be produced substantially easier simultaneously with this slot than would be true in case of continuous holes which are closed on all sides or in the case of corresponding blind holes.

This modified embodiment of the hinge of the invention affords the further advantage that the hinge pin can be made substantially shorter than the second hinge part so that fastening holes for the second hinge part on the second cabinet part, for instance on a cabinet door, can be provided at the ends of the hinge part and thus do not intersect the hinge pin. In particular, threaded holes for fastening bolts can extend far into the material of the second hinge part, whereby a particularly reliable attachment of this hinge part to the part of the cabinet in question is assured.

The ease with which this embodiment of the hinge in accordance with the invention can be taken apart furthermore makes it possible, with standardized development of the first hinge part as well as of the hinge arm, to use second hinge parts of different development, i.e. second hinge parts of different length, height, width, as well as shape. In this way a large number of possible combinations results, which is particularly advantageous when, in particular, the second hinge part is visible when the door is closed and thus forms an essential part in the overall appearance of a cabinet and must be adapted to the specific style of the cabinet. By these possibilities of combination, advantages are also obtained, of course, with respect to the maintaining of stocks since a cabinet manufacturer can adapt the hinge to the specific requirements by exchanging the hinge parts (first hinge part, second hinge part and/or hinge arm) for each other.

Further developments of the invention are set forth in this specification.

The invention will be explained in further detail below, with reference to illustrative embodiments. In the drawings:

FIG. 3 is a perspective exploded view of the cabinet-side parts of the hinge;

FIG. 4 is a perspective view of the first hinge part, seen in a view 180° away from FIG. 3;

FIG. 5 is a perspective exploded view of the second hinge part together with the hinge arm or tang to be anchored to said part, and the hinge pin;

FIG. 6 shows in perspective, by itself, a modified embodiment of the second hinge part for use in the hinge shown in FIG. 1;

Figures 1, 2:
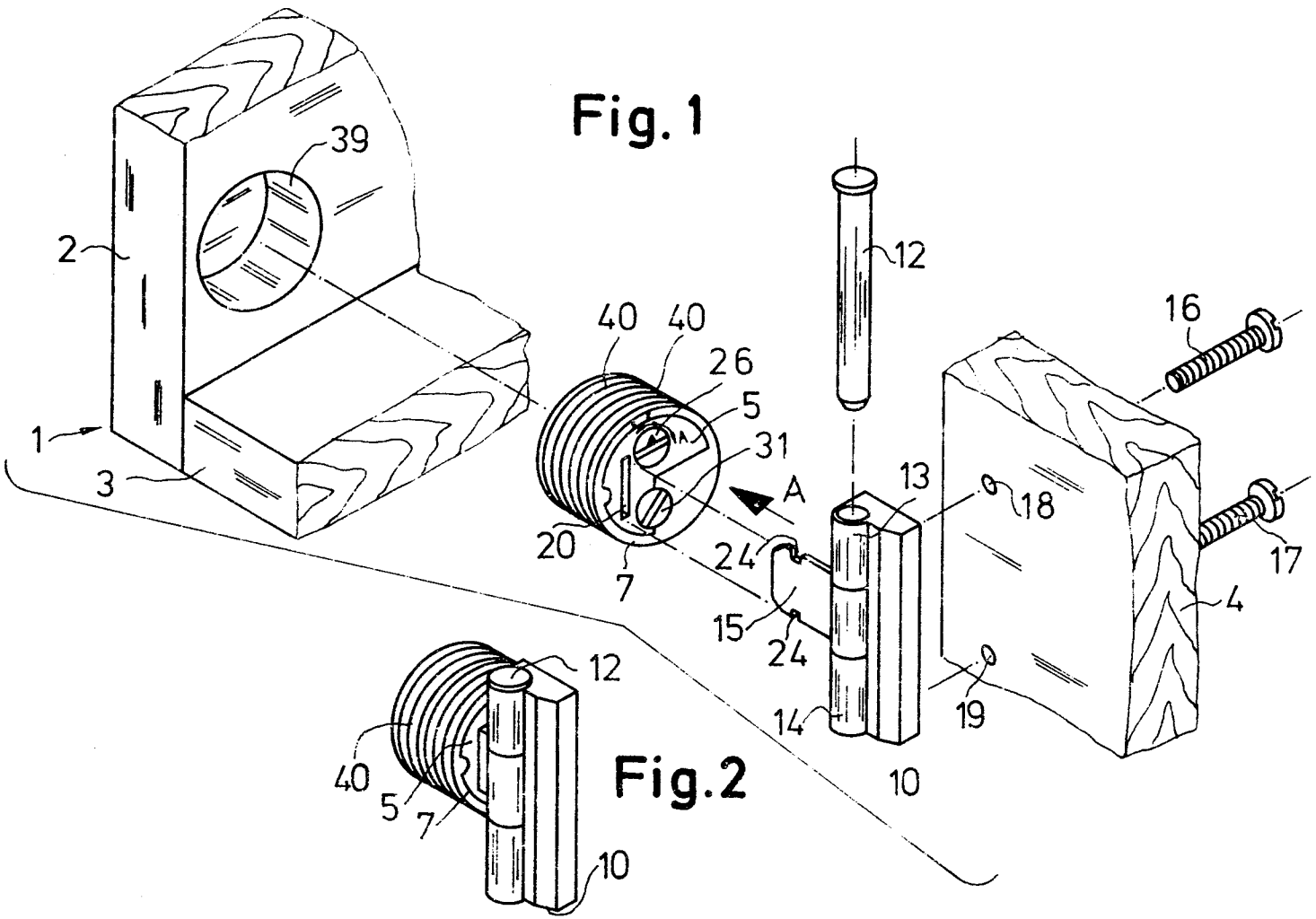
FIG. 1 is an exploded perspective view of a hinge in accordance with the invention having a single hinge pin and with hinge arm extending, in assembled condition of the hinge, perpendicular to the surface of the wall or body of the cabinet, the hinge parts being shown apart together with a partial showing of said cabinet wall or body and of a cabinet door.
FIG. 2 is a perspective view of the hinge of FIG. 1, with the hinge parts assembled.
Figure 8:
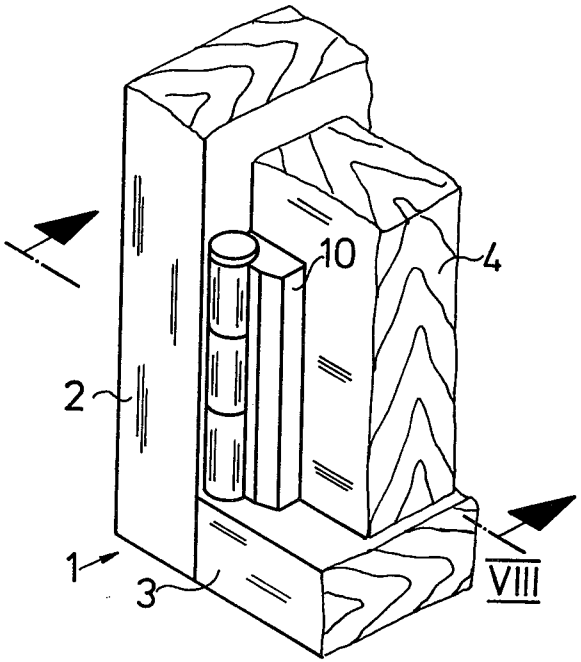
FIGS. 7 and 8 are partial showings in perspective of the cabinet body and cabinet door, together with the premounted hinge parts, before and after the assembling of the hinge in accordance with FIG. 1.
Figure 7:
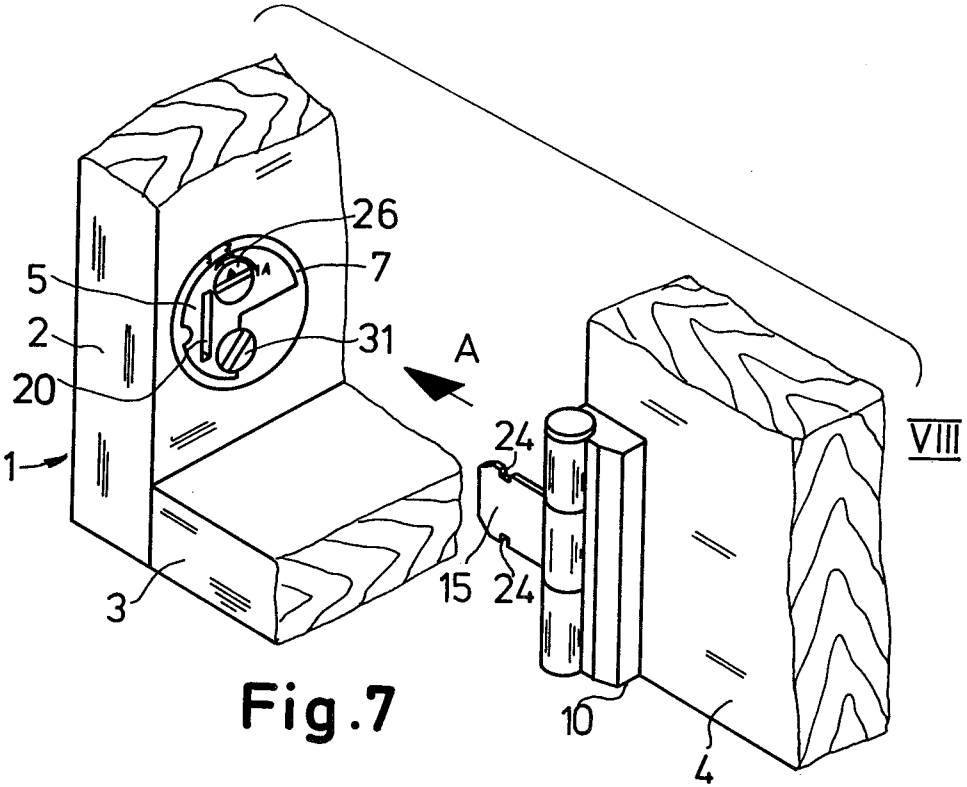
Figure 14:
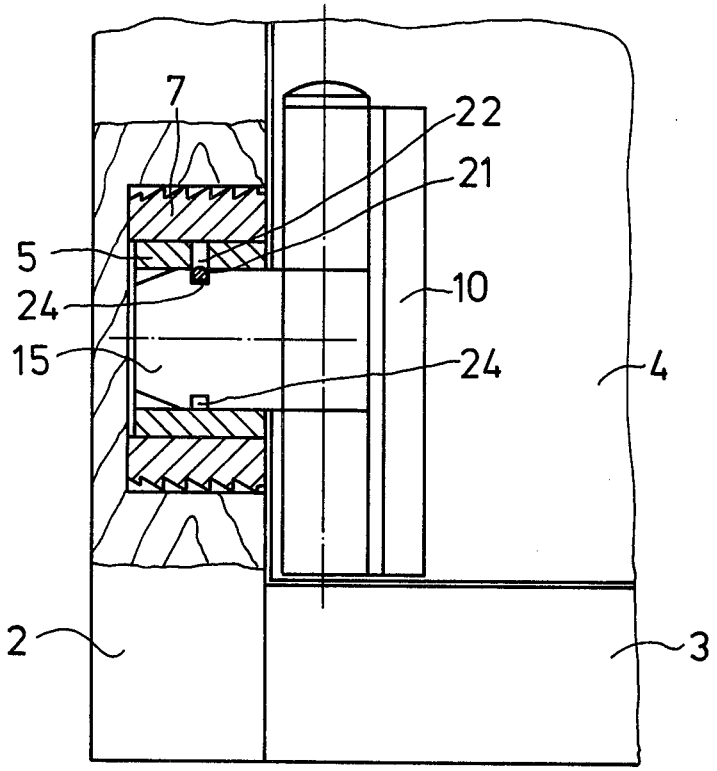
Figure 15:
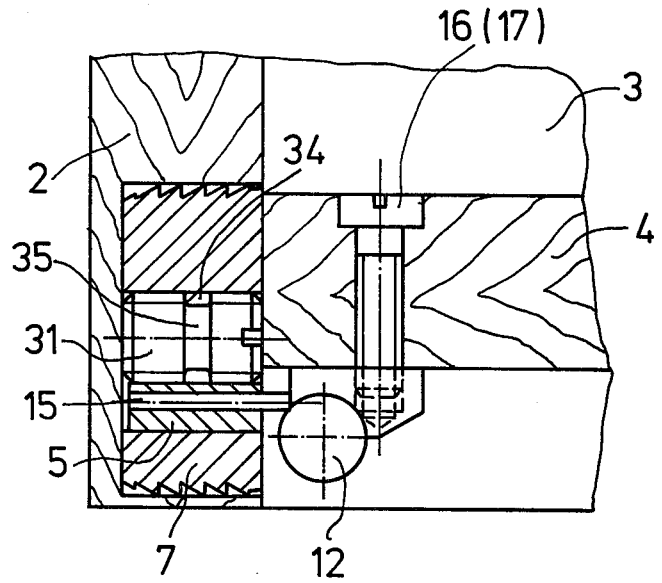
Figures 16, 17, 18:
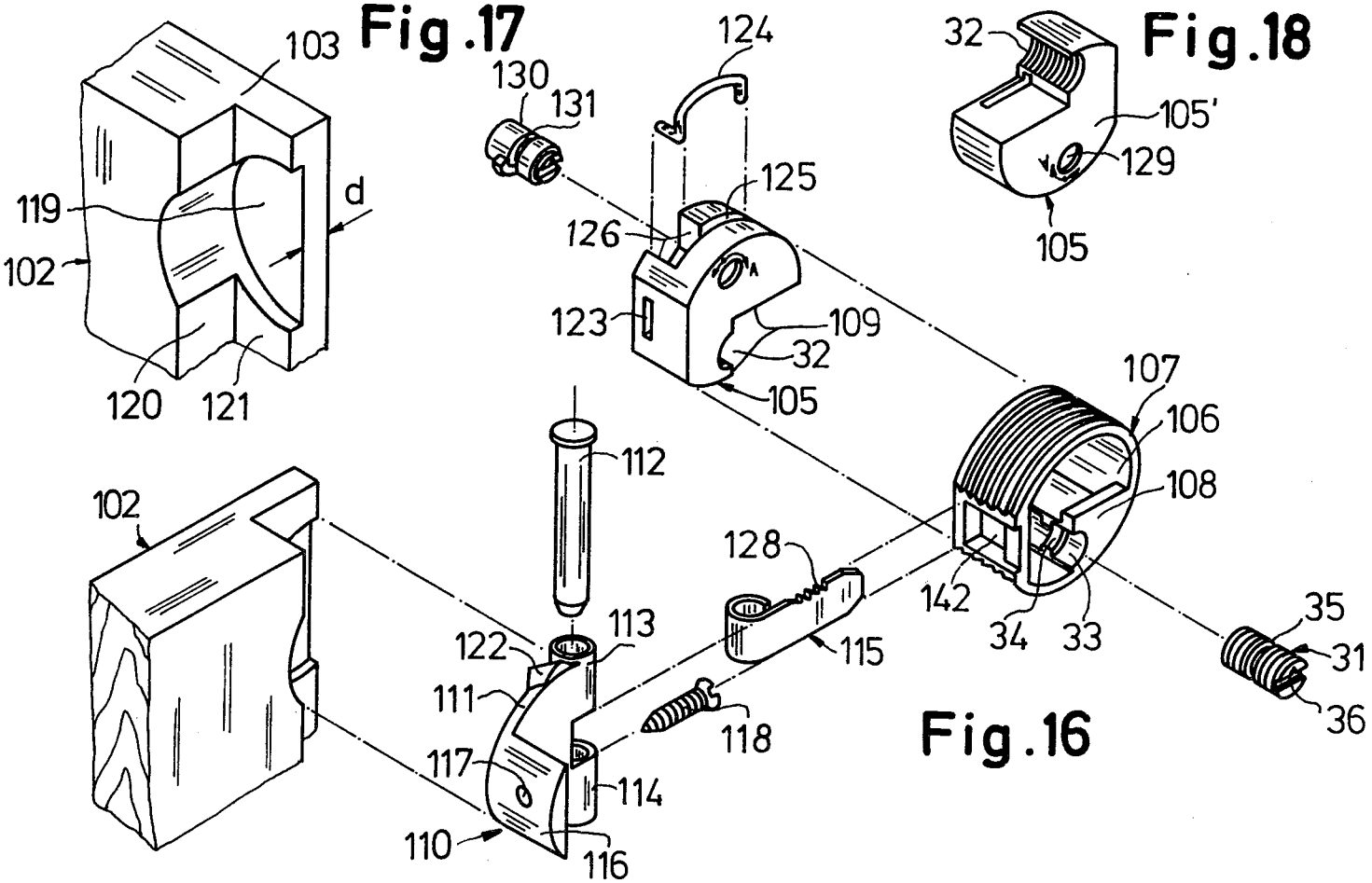
Figure 20:
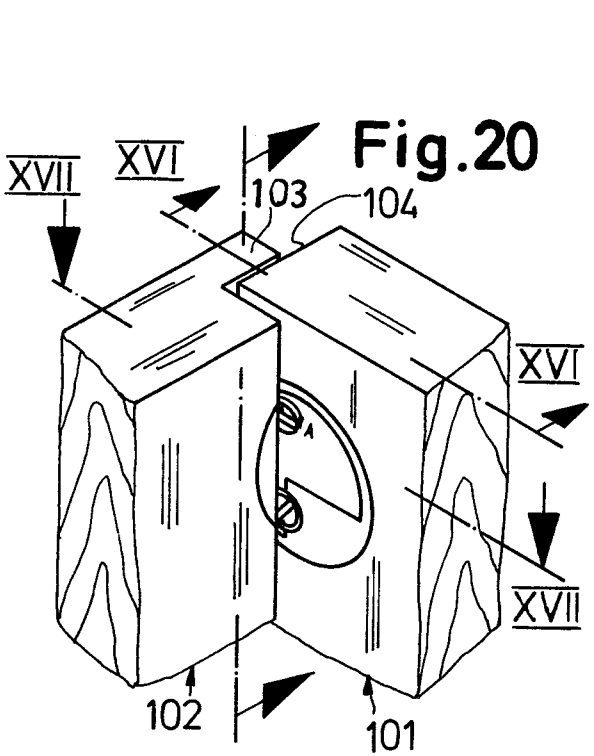
Figure 19:
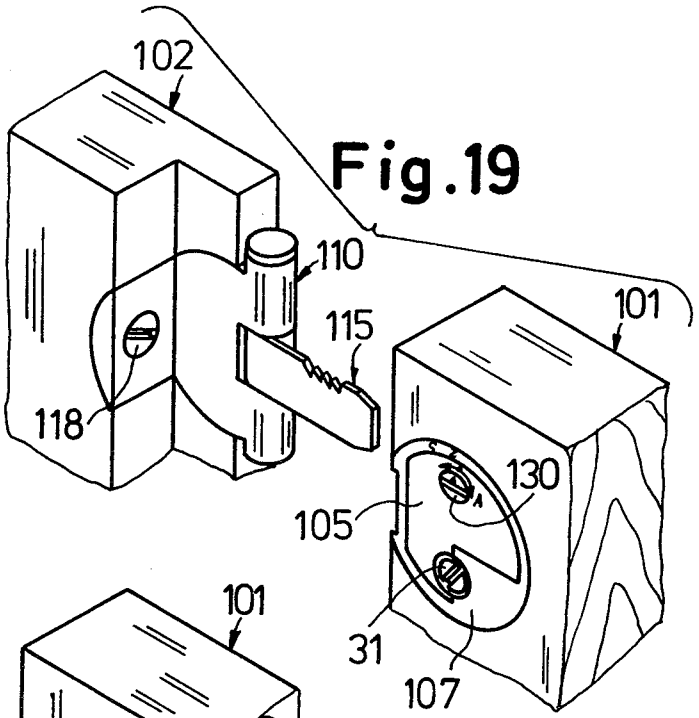
Figure 21:
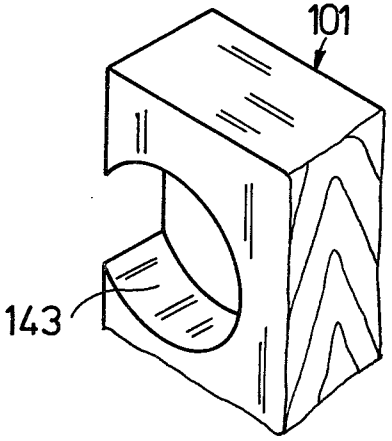
Figure 23C:
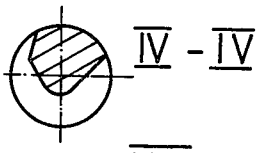
Figure 23A:
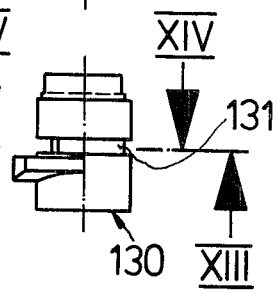
Figure 23B:
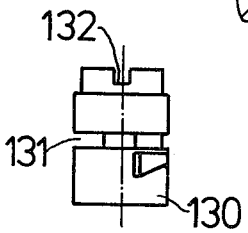
Figure 23D:
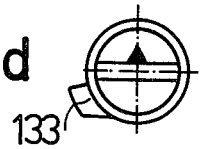
Figure 23E:
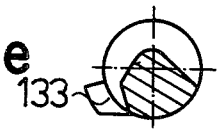
Figure 26:
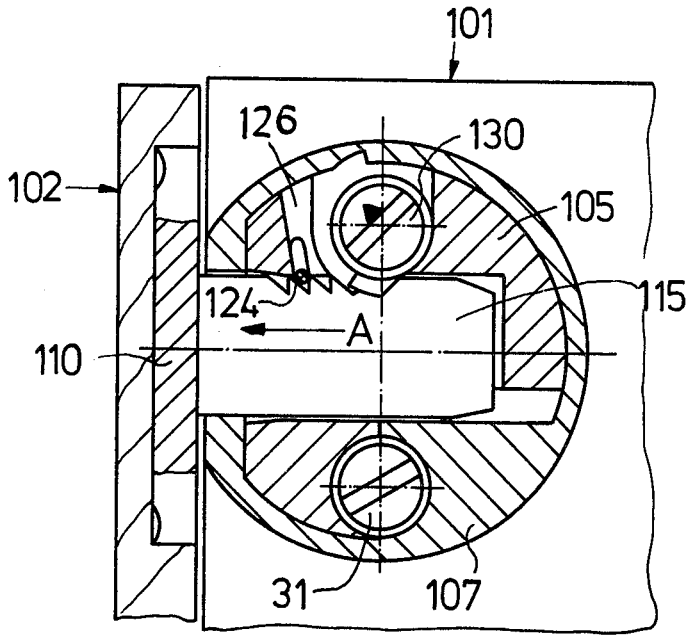
Figure 27:
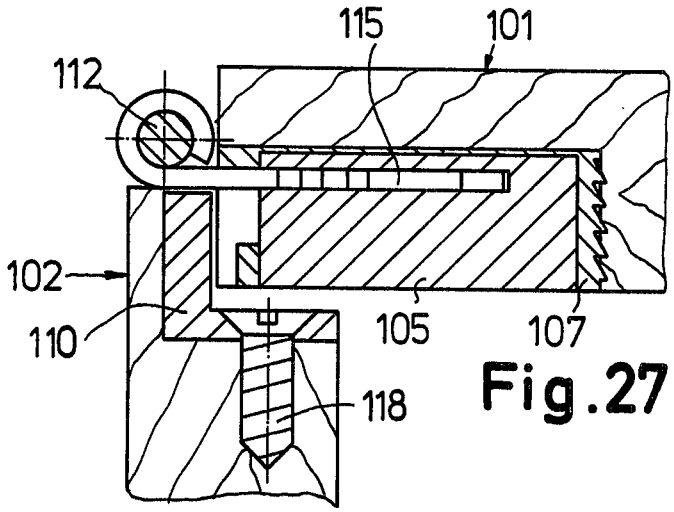
Figures 28, 29:
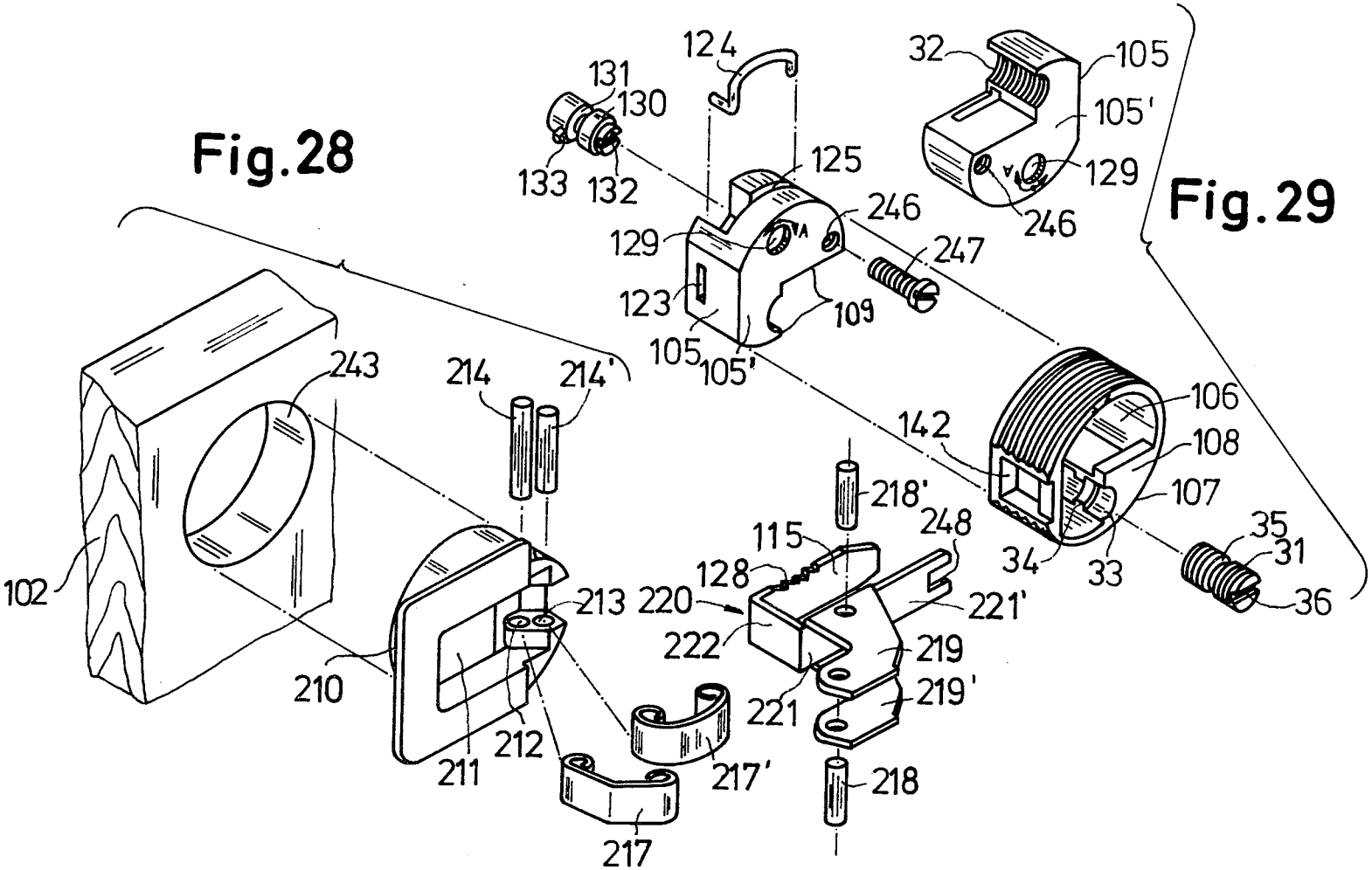
Figures 30, 31:
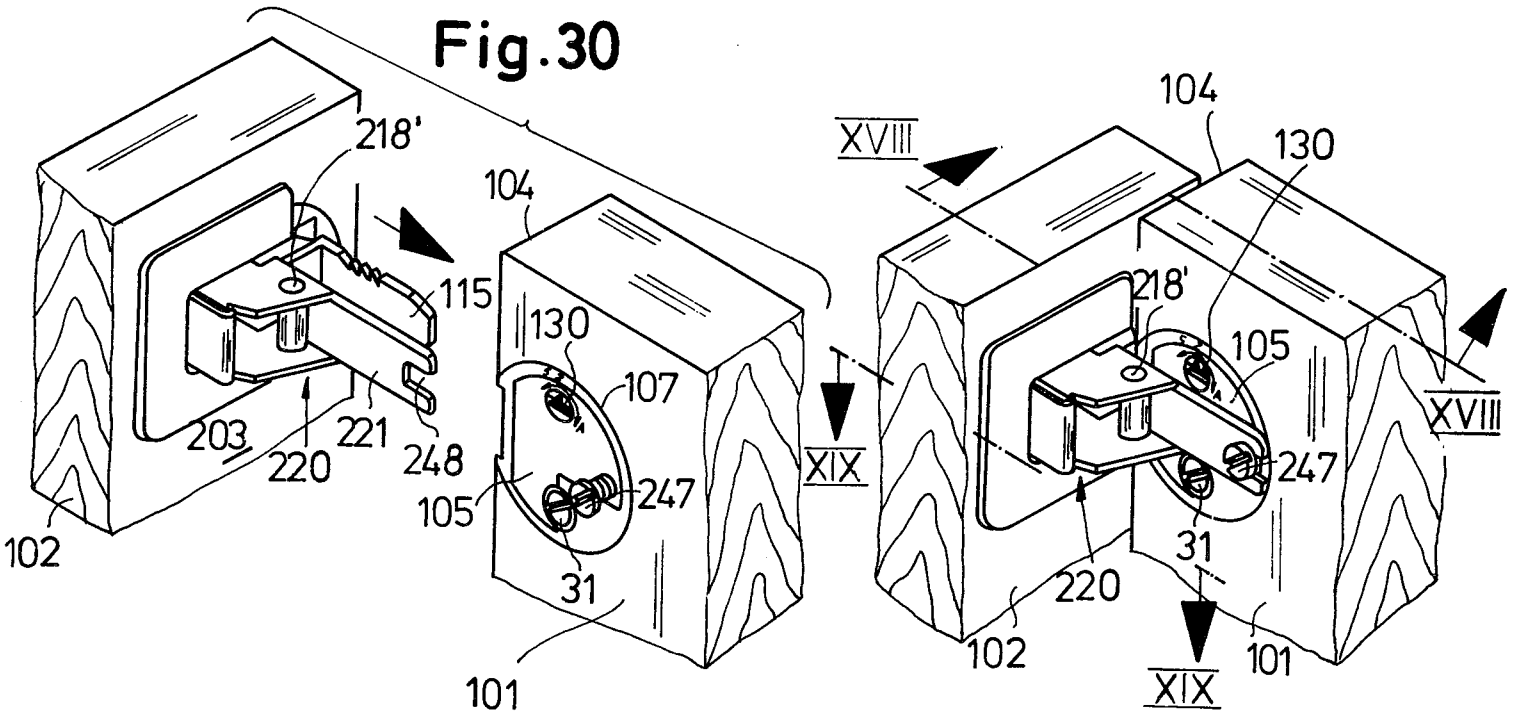
Figure 32:
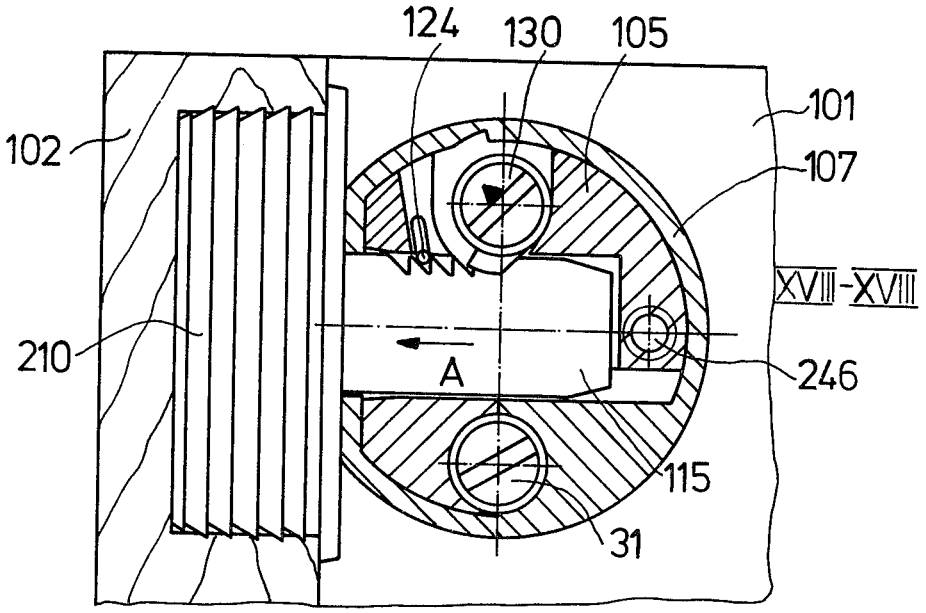
Figure 33:
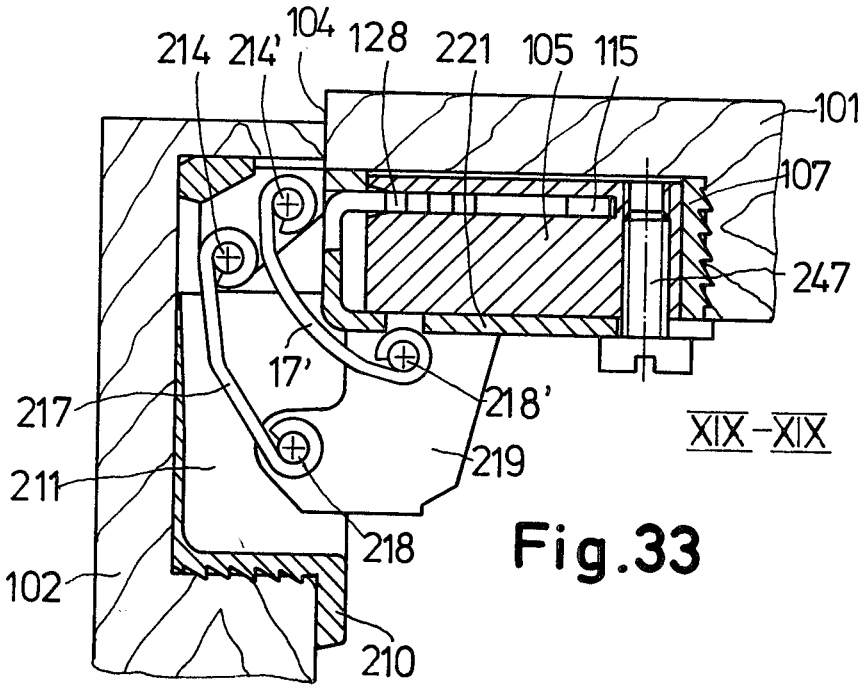
Figure 34:
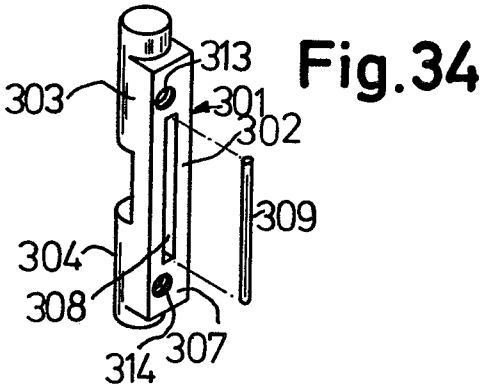
Figure 37:
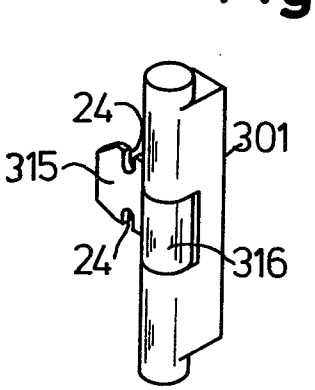
Figure 36:
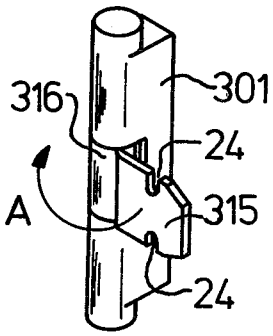
Figure 35:
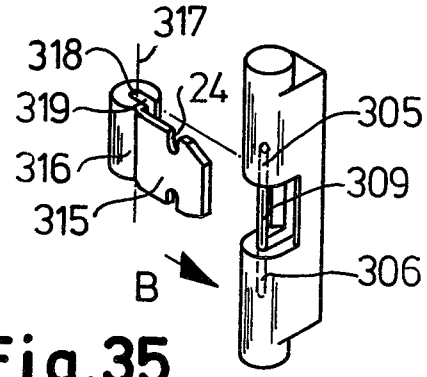
Figure 39:
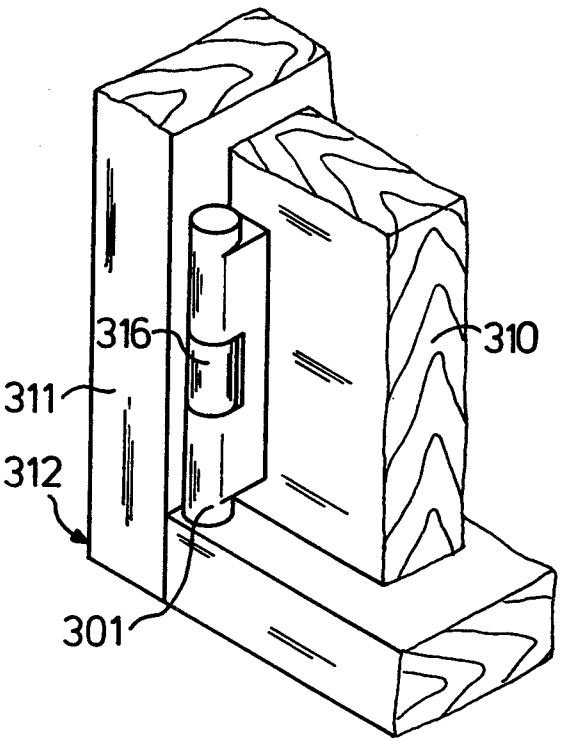
Figure 38:
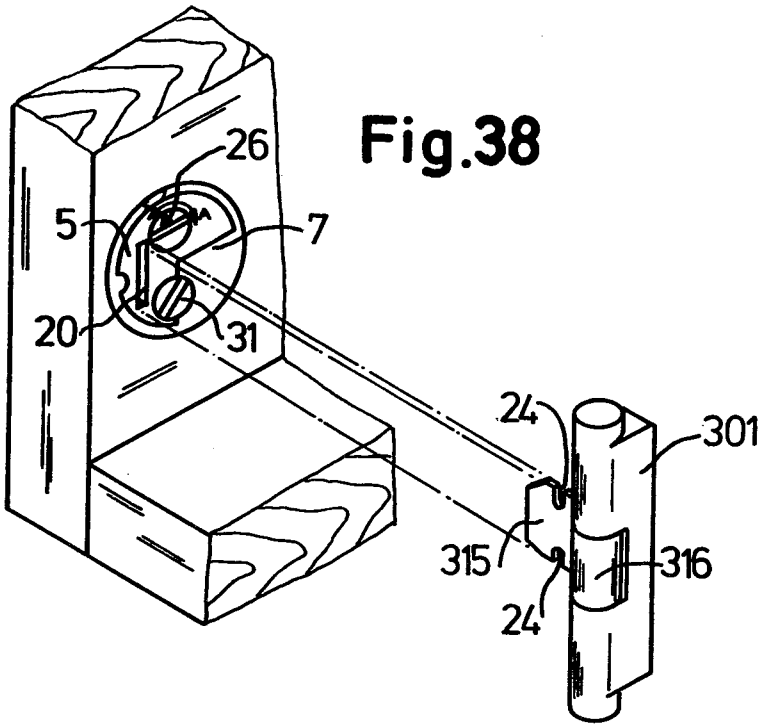
Figure 40:
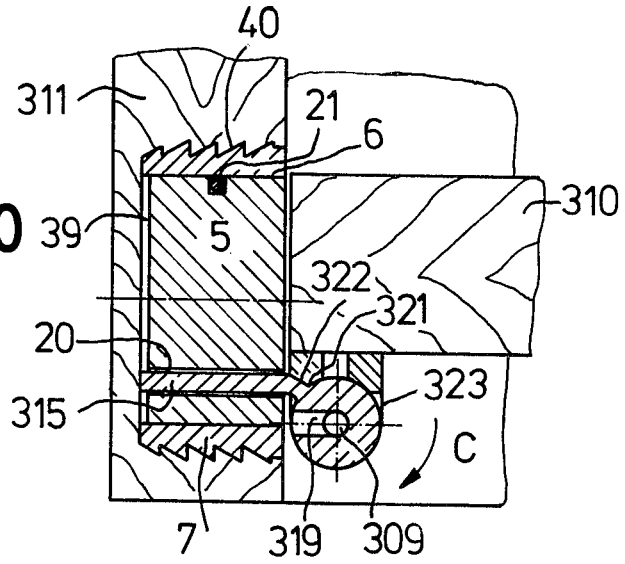
Figure 41:
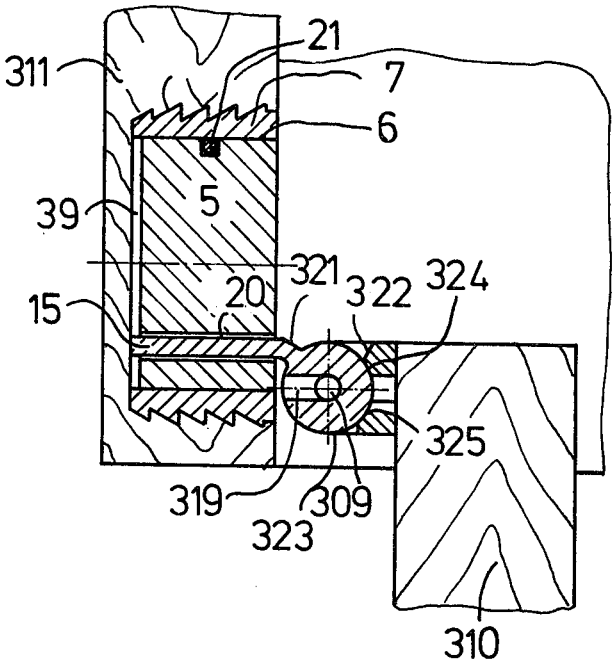

FIGS. 9*a* to 9*c* are a top view of the first hinge part and of the intermediate body surrounding said hinge part, a section along the line I—I, and a section along the line II—II;

FIGS. 10*a* to 10*e* show a locking and unlocking element for use with the hinge of FIG. 1 in a first side view, in a second side view turned through an angle of about 90°, in end view, and in sections along the lines III—III and IV—IV respectively;

FIG. 11 is a top view of the first hinge part, with the hinge arm or tang inserted in the recess of said hinge part;

FIGS. 12*a*-12*c* is a section through the first hinge part along the line V—V of FIG. 3 in different positions of the unlocking and locking element;

FIG. 13 is a cross section through the first hinge part, along the line VI—VI of FIG. 3;

FIG. 14 is a top view of the lower left corner of the cabinet body with the door closed, in a section through the intermediate body and first hinge part along the line V—V of FIG. 11;

FIG. 15 is a section through the side wall of the cabinet body and through the door along the line VIII—VIII of FIG. 8, the first hinge part being shown in section along the line IX—IX of FIG. 11;

FIG. 16 is a perspective exploded view of a second embodiment of a hinge in accordance with the invention, having a single hinge pin and a hinge arm which in the assembled condition of the hinge extends parallel to the surface sides of the cabinet wall or cabinet body, together with a partial showing of a cabinet door;

FIG. 17 is a perspective partial view of the cabinet door of FIG. 16, but turned 90° from the position shown in FIG. 16;

FIG. 18 is a perspective partial showing of the first hinge part, but turned 180° from the showing of FIG. 16;

FIG. 19 is a perspective partial view of a cabinet body or cabinet wall as well as of the cabinet door with the hinge parts mounted, but before assembly of the hinge in accordance with FIG. 16;

FIG. 20 is a showing similar to FIG. 19, but after the assembling and putting together of the hinge parts;

FIG. 21 is a perspective showing of the cabinet body or cabinet wall in the region of the bore hole which receives the first hinge part or a bushing-like intermediate body of said hinge part;

FIGS. 22*a* to 22*d* are a top view of the first hinge part and of the intermediate body surrounding said hinge part, a section along the line X—X, a section along the line XI—XI, as well as a section along the line XII—XII with the unlocking and locking member locked, in the case of a modified embodiment;

FIGS. 23 to 23*e* show the unlocking and locking element for use with the hinge of FIG. 16 in a first side view, in a second side view turned 90° therefrom, in section along the line XIII—XIII, in end view, and in section along the line XIV—XIV;

FIGS. 24*a* and 24*b* show in individual showing the first hinge part together with the intermediate body, in top view, as well as in side view;

FIGS. 25*a* to 25*c* are a section along the line XV—XV of FIG. 24*b* in different positions of the unlocking and locking element;

FIG. 26 is a showing of the cabinet door as well as of the cabinet body or cabinet side wall, the cabinet door as well as the cabinet body being shown in section along the line XVI—XVI of FIG. 20;

FIG. 27 is a section through the cabinet body and through the cabinet side wall, as well as through the cabinet door along the line XVII—XVII of FIG. 20;

FIG. 28 is a perspective exploded view of a third embodiment of the hinge of the invention with four hinge pins together with a partial showing of the cabinet door;

FIG. 29 is a perspective showing of the first hinge part, turned 180° as compared with FIG. 28;

FIG. 30 is a perspective partial view of the cabinet body or cabinet side wall and the cabinet door with hinge parts mounted on this cabinet body and on the cabinet door, but before the assembling of the hinge in accordance with FIG. 28;

FIG. 31 is a showing similar to FIG. 30, but after the assembling or putting together of the hinge parts;

FIG. 32 is a showing of the cabinet door and of the cabinet body or a side wall, the cabinet door, as well as the cabinet side wall, being shown in vertical section along the line XVIII—XVIII of FIG. 31;

FIG. 33 is a showing of the cabinet door and of the cabinet body or cabinet side wall, the cabinet body as well as the cabinet side wall being shown in horizontal section along the line XIX—XIX of FIG. 31;

FIG. 34 is a perspective showing of the hinge part to be fastened to a cabinet door in the case of a further embodiment of the hinge in accordance with the invention, together with the hinge pin, seen from the fastening side;

FIG. 35 is a perspective showing of the hinge part of FIG. 34 with the hinge pin arranged in this hinge part, together with a hinge arm having the bearing part, prior to the assembly;

FIG. 36 shows in perspective the hinge parts of FIG. 35 after the bearing part has been placed over the hinge pin;

FIG. 37 is a showing similar to FIG. 36 but after the hinge arm has been swung 180° in the direction indicated by the arrow A;

FIG. 38 shows in perspective the hinge parts of FIG. 37 together with the lower hinge-side corner of a cabinet body shown in part, in the side wall of which cabinet body a member serving to hold the hinge arm is anchored;

FIG. 39 shows in partial perspective view a recessed cabinet door as well as the cabinet body, together with the hinge connecting these two parts;

FIGS. 40 and 41 are a section through the cabinet side wall, through the cabinet door, and through the hinge in different swung positions of the cabinet door.

Referring to the figures, 1 is a cabinet body of which, for simplicity in showing, only the lower left-hand corner has been shown, formed by a cabinet side wall 2 and a cabinet bottom 3. To this cabinet 1 a cabinet door 4 is to be swingably attached by means of a hinge in such a manner that, when closed, it lies within the opening formed by the cabinet side walls, the cabinet bottom, and the cabinet top (see FIGS. 8, 14 and 15). The hinge consists of the adjusting body or slide 5 which forms the first hinge part and is held adjustably or displaceably in a recess 6 (FIG. 3) of a substantially bushing-shaped intermediate body 7 in direction perpendicular to the surface of the side wall 2 of the cabinet and in the axial direction of the intermediate body 7.

In the embodiment shown in the drawing, the adjustment body has a cross section of the shape of part of a circle (three quarters of a circle) or of a circular segment, the recess 6 of the intermediate body being adapted to this cross section and engaging, by an extension 8 having the shape of a circular segment, which extends into the recess 6, into the segment-shaped recess 9 of the adjustment body 5. In this way, assurance is had that the adjustment body 5 can be shifted or adjusted perpendicular to the surface of the side wall 2 of the cabinet, but cannot turn relative to the intermediate body 7.

The hinge shown consists, furthermore, of a second hinge part 10 or 10' which is formed essentially of a fastening plate 11 or 11' which has knuckles 13 or 14 formed on one surface serving to support the single hinge pin 12, said knuckles being at such a distance from one another that they can receive between each other the end, rolled together so as to form a hinge knuckle, of an arm or tang 15 articulated by the hinge pin 12 to the hinge part 10 or 10'. The hinge part 10 or 10' is screwed to the outside of the cabinet door 4 from that side of its surface which is opposite the knuckles 13 and 14, by means of bolts 16 and 17, the bolts passing through bore holes 18 and 19 of the cabinet door 4 and engaging in threads (not shown) in the fastening plates 11 and 11' respectively, their heads resting against the inner side of the cabinet door 4.

While in the case of the hinge part 10, the knuckles 13 and 14 are formed asymmetrically, i.e. on a longitudinal edge of the somewhat wider fastening plate 11, the corresponding knuckles in the case of the narrower fastening plate 11' are symmetrical to the longitudinal edges thereof. The hinge pin 12 is preferably held by a force-fit in the knuckles 13 and 14. In order to connect the arm or tang 15 with the adjustment body 5, the said adjustment body has a continuous recess 20 which extends perpendicular to the upper or inner surface of the side wall 2 of the cabinet and, in the embodiment shown, is of a rectangular cross section which is adapted to the strip material of the arm or tang 15. Into this recess there extends the free end of a locking element which is formed by a hoop 21 of spring wire. This wire hoop 21 lies in a slot 22 which is open on the outside of the adjustment body 5, extends transversely to the recess 20, and opens into said recess (FIGS. 12*a*–12*c*).

On the end of the slot 22 which faces away from the recess 20 there is provided a bore hole 23 into which the bent end of the wire hoop 21 extends for the anchoring thereof. The other end of the wire hoop 21 is guided freely in the slot 22 and engages, with spring action, under certain conditions (which will be described further below) into a groove 24 on the side edge of said tang when the tang 15 is inserted into the recess 20. In the embodiment shown, a groove 24 is provided both on the lower longitudinal side of the tang 15 and on its upper longitudinal side, which has the advantage that one and the same hinge can be used for doors opening on the left side or the right side, merely by turning the hinge part 10 or 10' which is completely assembled with the arm 15.

In order to make possible the unlocking of the wire hoop 21, which serves as detent element, an unlocking and locking element 26 is arranged turnable around an axis parallel to the recess 20 in the adjustment body 5 or in a bore hole 25 of said adjustment body, which locking and unlocking element has a ring-shaped circumferential groove 27 approximately in its center. This groove, which preferably extends around the entire circumference of the unlocking and locking element 26, is of different depth and forms an eccentric surface cooperating with the wire hoop 21 approximately in the center of this wire hoop, by means of which eccentric surface the wire hoop 21 which extends into the groove 27 can be lifted by turning the unlocking and locking element 26 in the bore hole 25, against the natural elasticity of the material of the hoop to such an extent that the free end of the wire hoop 21 comes out of engagement with the groove 24 so that the tang 15 can be pulled out of the recess 20. This position of the unlocking and locking element corresponds to FIG. 12*c*.

Upon the turning of the unlocking and locking element 26 back in counterclockwise direction into the position shown in FIG. 12*b*, the free end of the wire hoop 21, due to the eccentric bottom surface of the groove 27, again moves so far into the recess 20 that this free end can snap into the groove 24 upon the introduction of the arm 15 into the recess 20 and can lock the arm or tang 15 in the recess 20.

Cooperation of the unlocking and locking element 26 with the wire hoop 21 is possible for the reason that the slot 22 simultaneously also intersects the bore hole 25 for the unlocking and locking element 26. Since the groove 27 of the unlocking and locking element 26 extends over the entire circumference of this element, it is possible so to shape the wire hoop 21 that even upon a complete rotation of the unlocking and locking element 26 it remains in the groove 27 of said element, as a result of which the unlocking and locking element 26 is secured by the wire hoop 21 against unintentionally falling out of the bore hole 25.

At its one end, the substantially cylindrical locking and unlocking element 26 has a slot 28 for the engaging of a screwdriver (not shown), by which the locking and unlocking element 26 can be turned into different positions. On its side away from the slot 28 the locking and unlocking element is furthermore provided with a circumferential surface 29 which forms another eccentric surface by means of which the arm or tang 15 is additionally clamped fast in the recess 20 when the locking and unlocking element 26 is turned in counterclockwise direction out of the position shown in FIG. 12*b* into the position shown in FIG. 12*a*. In this position, the eccentric surface 29 extends through a corresponding opening in the recess 20 and lies pressed against the surface of the arm or tang 15. The different positions of the locking and unlocking element 26 are indicated by, for instance, a triangular mark 30 on the locking and unlocking element 26, this mark 30 corresponding to markings on the top of the adjustment body 5 which are designated "S", "Z", and "A" in FIGS. 11 and 12*a*–12*c*.

The adjustable displacement of the adjustment body 5 in the intermediate body 7 is effected by means of an adjustment screw 31 which is developed as a headless screw and lies in semicircular recesses 32 and 33 of the adjustment body 5 and the intermediate body 7, respectively. The semicircular recesses 32 and 33, which supplement each other to form a closed circular bore hole, are provided on, in each case, one surface of the circular segment-shaped recess 9 and of the circular-segment-shaped extension 8, the recess 32 having a thread (FIG. 4) which cooperates with the thread of the adjusting screw 31. The recess 33 which has no thread is provided approximately in its center with a web 34 which extends transverse to the longitudinal axis of the recess and engages in an annular groove 35 approximately in the center of the adjusting screw 31 and holds said adjustment screw immovable in axial direction relative to the intermediate body 7. By turning the adjustment screw, for instance by means of a screwdriver engaged in the slot 36 of said screw, the adjustment body 5 can be displaced perpendicular to the surface of the side wall 2 of the cabinet in the recess 6 of the intermediate body 7 in order to compensate for manufacturing tolerances in the manufacture of the cabinet, and in the fastening of the hinge etc. Since the thread of the adjustment screw 31 engages into the thread of the semicircular recess 32 and at the same time the web 34 lies in the annular groove 35 of the adjustment screw 31, undesired displacement of the adjustment body 5 relative to the intermediate body 7, i.e. without rotation of the adjustment screw 31, is not possible.

In addition to the possible adjustment perpendicular to the surface of the side wall 2 of the cabinet, the use of an intermediate body 7 surrounding the adjustment body 5 has, in particular, also the advantage that the slot 22 of the adjustment body, which slot is open towards the outside, is closed by the intermediate body 7 so that after the introduction of the adjustment body 5 into the recess 6 of the intermediate body 7 the undesired falling out from the slot 22 of the wire hoop 21 which serves as detent element is not longer possible, as a result of which at the same time also the locking and unlocking element 26 is held fast in the bore hole 25 by the wire hoop which engages into the groove 27. All parts of the adjustment body 5 are thus held together in nonlosable fashion in a particularly simple manner after the introduction of said adjustment body into the recess 6 of the intermediate body 7.

The assembling of the hinge parts is effected in approximately the sequence indicated in FIGS. 3 and 5. First of all the locking and unlocking element is so introduced into the bore hole 25 from the rear side (not shown in FIG. 3) of the adjustment body 5 that the end of said locking and unlocking element 26, which is somewhat reduced in cross section and provided with the slot 28, lies in a section of the bore hole 25 on the front of the adjustment body 5 which (section) has a somewhat smaller cross section than the rest of the bore hole 25 and thus establishes, in order to facilitate the mounting, a well-defined position for the locking and unlocking element 26 in the bore hole 25. Thereupon, the wire hoop 21 is inserted into the slot 22 in such a manner that the bent end of said hoop lies in the bore hole 23. The adjustment screw 31 is now so inserted into the semicircular recess 33 that the web 34 engages in the annular groove 35. The adjustment body 5 is then so placed on the rear of the intermediate body 7 that the recess 6 of the intermediate body coincides with the adjustment body 5. By turning the adjustment screw 31, the adjustment body 5 is then pulled by said adjustment screw 31 into the recess 6 of the intermediate body 7.

In order to avoid improper assembly of the adjustment body 5 and of the intermediate body 7 and to provide an additional guide between these two parts, it is furthermore advisable to provide, on the outer circumference of the adjustment body 5, an additional longitudinal groove 37 into which a corresponding extension or rib 38 extending into the recess 6 engages.

The assembling of the hinge part 10 or 10' with the arm or tang 15 is effected by pushing the end of said tang 15 which is rolled together to form a hinge knuckle into position between the knuckles 13 and 14 and causing it to coincide with the bore holes of said knuckles so that thereupon the hinge pin 12 can be pushed from above through the bore hole of the knuckle 13 and through the rolled end of the arm or tang 15 into the bore hole of the knuckle 14.

The fastening of the hinge to the cabinet is effected in the manner that the intermediate body 7, together with the adjustment body 5, is so anchored in a bore hole 39 on the side wall 2 of the cabinet that the longitudinal edges of the rectangular recess 20 extend parallel to the front edge of the side wall 2 of the cabinet. The anchoring of the intermediate body 7 in the bore hole 39 is effected in known manner, for instance by barb-like extensions or ribs 40 formed on the outer circumference of the intermediate body 7, or else by means of inclined screws, gluing, etc.

The hinge part 10 or 10' is premounted, together with the arm or tang 15 pivoted to said part, on the front side of the cabinet door by means of the bolts 16 and 17. The final mounting of the cabinet door 4 to the cabinet 1 is then effected by introducing the free end of the tang or arm 15 into the recess 20 and anchoring it there by engagement of the wire hoop 21 into the groove 24. The locking and unlocking element 26 is in this connection turned in such a manner that the mark 30 is directed to the position "Z". After the engagement of the wire hoop 21 in the groove 24, the locking and unlocking element 26 is so turned in counterclockwise direction that the mark 30 points to the position "S", whereby the arm or tang 15 is clamped in the manner described above by the locking and unlocking element 26 or its eccentric surface 29 in addition in the recess 20. If the cabinet door 4 is to be removed again for any reason from the cabinet 1, the locking and unlocking element 26 is so turned in clockwise direction that the mark 30 is directed to the position "A" in which the free end of the wire hoop 21 comes out of engagement with the groove 24 so that the arm or tang 15 can be pulled unimpeded out of the recess 20 of the adjustment body 5.

FIGS. 16 to 27 show another embodiment of the inventive hinge having a single hinge pin 112, and in this embodiment, when the hinge is assembled, the hinge arm or tang 115 lies parallel to the surface sides of the side wall 101 of the cabinet, of which, for greater simplicity in showing, merely the left-hand upper hinge-side corner has been shown. A cabinet door 102 is to be swingably fastened to said cabinet or to this cabinet side wall 101 by means of a hinge in such manner that the cabinet door when closed swings partially into the opening formed by the side walls, bottom, and top of the cabinet and rests by means of a protruding edge 103 against the end surface 104 of the side wall 101 of the cabinet (see FIG. 20). The hinge shown in these FIGS. 16 to 27 consists of an adjustment body or slide 105 forming the first hinge part and supported adjustably and displaceably in a recess 106 (FIG. 16) of a substantially bushing-shaped intermediate body (107) in direction perpendicular to the surface of the side wall 101 of the cabinet and in the axial direction of the intermediate body 107.

In the embodiment shown, the adjustment body 105 has the cross section of part of a circle (three quarters of a circle), the recess 106 of the intermediate body 107 being adapted to this cross section and engaging, by means of an extension 108 of circular-segment shape which engages into the recess 106, into the circular-segment shaped recess 109 of the adjustment body 105. In this way, assurance is had that the adjustment body 105 while it can be displaced or adjusted perpendicular to the surface of the side wall 101 of the cabinet cannot carry out any rotation relative to the intermediate body 107. The hinge shown consists furthermore of a second hinge part 110 which is formed essentially of a plate 111 having the shape of a partial circle or semicircle which is formed on the side facing away from the circular outer surface and has knuckles 113 and 114 serving for the supporting of the single hinge pin 112, said knuckles being such a distance apart that they can receive between each other the end, rolled into a knuckle, of a hinge arm or tang 115 pivoted by the hinge pin 112 to the hinge part 110. For attachment to the cabinet door 102 there is furthermore formed on the plate 111 of partial circular shape, on the side opposite the knuckles 113 and 114, a wall section 116 which extends perpendicular to the surface sides of the plate 111 and has a bore hole 117 for the fastening screw 118. The placing or fastening of the hinge part 110 on the door 102 of the cabinet is effected in a bore hole 119 open towards the front side in the edge 103, this bore hole, as shown in particular in FIG. 17, continuing also in the rest of the door 102. The hinge part 110 is pushed laterally into the bore hole 119 in such a manner that the plate 111 comes to lie in the part of the bore hole 119 within the edge 103 while the wall section 116 comes to lie in the continuation of the bore hole 119 on the inner rabbet edge 120 and is held fast there by screwing the fastening screw 118 into the material of the cabinet door 102. The depth and development of the bore 119 as well as the shape and thickness of the plate 111 and of the wall section 116 are so selected that the surfaces of the plate 111 and of the wall section 116 which are visible after the attachment of the hinge part 110 to the cabinet door 102 are flush with the surfaces 120 and 121 of the cabinet door (see FIG. 19). The knuckles 113 and 114 for the hinge pin 112 lie in this connection in front of the front surface of the edge 103. Since the edge 103 as a rule is of very slight thickness and thus it is not possible for a fastening screw to penetrate perpendicular to the surface sides of the door 102 into said edge 103, additional laterally protruding fastening projections 122 are provided on the plate 111 in the vicinity of the knuckles 113 and 114, said projections penetrating laterally into the wall of the bore hole 119 and into the material of the edge 103 upon the tightening of the fastening screw 118 and thereby providing additional anchoring of the hinge part 110 against accidental pulling out.

In order to connect the hinge arm or tang 115 with the adjustment body 105, said adjustment body has a recess 123 which extends parallel to the upper and inner surfaces of the side wall 101 of the cabinet and which, in the embodiment shown, has a rectangular cross section adapted to the metalstrip material of the arm or tang 115. Into this recess there extends the free bent end of a locking element, which is formed by a hoop 124 of spring wire. This wire hoop 124 lies in a slot 125 which is open towards the outside of the adjustment body 105, extends parallel to the recess 123, and is staggered slightly with respect to the recess 123 on the front side 105' of the adjustment body 105. The slot 125 opens into the recess 123 via a recess 126 which extends substantially perpendicular to the longitudinal axis of the slot 125 (FIG. 25*a*–25*c*).

On the end of the slot 125 facing away from the recess 126 there is provided a bore hole 127 in which the second bent end of the wire hoop 124 extends in order to anchor it. The other bent end of the wire hoop 124 is guided on basis of the corresponding curvature of this wire hoop, in the recess 126 and engages under spring action, under certain conditions which will be described below, into one of the sawtooth shaped depressions 128 on a side edge of the hinge arm or tang 115 when the tang 115 is pushed into the recess 123 from the side. It may be advisable to provide such sawtoothlike depressions 128 on both side or longitudinal edges of the hinge arm 115 in order to be able to use one and the same hinge for right-hand and left-hand doors merely by reversing the hinge part 110 which has been preassembled with the hinge arm 115. The sawtooth depressions 128 are so developed that the substantially vertical portion of these depressions is directed in each case towards the end of the arm 115 which is rolled together to form a knuckle, while the section of the depressions 128 which extends obliquely to the longitudinal axis of the arm faces the free end of said arm. In this way the hinge arm or tang 115 can be pushed as required to a greater or lesser depth into the recess 123, the undesired pulling of the hinge arm 115 out of the recess 123 not being possible without unlocking the detent element or the wire hoop 124. The surface 126' of the recess 126 which faces the end surface 104 of the side wall 101 of the cabinet serves as stop surface of the bent first end of the wire hoop 124 and prevents the distorting of the wire hoop engaged in a depression 128 when forces are exerted on the arm or tang in the direction indicated by the arrow A in FIG. 26.

In order to make it possible to unlock the wire hoop 124 which serves as detent element an unlocking and locking element 130 is arranged rotatable about an axis perpendicular to the recess 123 in the adjustment body 105 or a bore 129 of said adjustment body, said unlocking and locking element having an annular circumferential groove 131 approximately in its center. This circumferential groove, which preferably extends over the entire circumference of the unlocking and locking element 130, has different depths and thereby forms an eccentric surface cooperating with the wire hoop 124 approximately in the center of said wire hoop, by means of which the wire hoop 124 extending into the groove 131 can, by turning the unlocking and locking element 30 in the bore 129 in direction opposite the natural elasticity of the hoop material used, be lifted or pressed aside to such an extent that the free, first bent end of the wire hoop 124 moves out of the recess 123 and comes out of engagement with the corresponding depression 128 of the hinge arm or tang 115, so that this arm can be pulled out of the recess 123 without being impeded by the wire hoop 124 which serves as detent element. This position of the unlocking and locking element 130 corresponds to FIG. 25*c*.

Upon the turning of the locking and unlocking element 130 backward in counterclockwise direction into the position shown in FIG. 25*b*, the free, first bent end of the wire hoop 124, due to the eccentric bottom surface of the groove 131 and the inherent elasticity of the wire hoop 124 moves to such an extent into the recess 123 that said free end, upon the introduction of the hinge arm 115 into the recess 123, can snap into the depression 128 and lock the hinge arm or tang 115 in the recess 123.

Cooperation of the unlocking and locking element 130 with the wire hoop 124 is possible because the slot 125 at the same time also intersects the bore hole 129 for the rotatable supporting of the unlocking and locking element 130. Since the circumferential groove 131 extends over the entire circumference of the unlocking and locking element 130 it is possible to shape the wire hoop 124 in such a manner that even upon a full revolution of the unlocking and locking element 130 it remains in the groove 131 as a result of its inherent elasticity, as a result of which the unlocking and locking element 130 is secured by the wire hoop 124 against unintentionally sliding out of the bore hole 129.

At its end which is somewhat reduced in cross section the substantially cylindrical unlocking and locking element 130 has a slot 132 for the engagement of a screwdriver (not shown in detail) by which the unlocking and locking element 130 can be turned into the different positions. On the side of the circumferential groove 131 facing away from the slot 132, the unlocking and locking element 130 is furthermore provided with a radial extension 133 of wedge-shaped varying thickness by means of which the hinge arm or tang can be additionally clamped fast in the recess 123 when the unlocking and locking element 130 is turned out of the position shown in FIG. 25*a*–25*c* into the position shown in FIG. 25*a*. In this position, the radial extension 133 lies in a lateral broadening 134 of the recess 123 and, depending on the position of rotation of the unlocking and locking element 130, extends to a greater or lesser depth laterally into the recess 123, whereby the radial extension 133, one surface side of which rests against the bottom of the lateral broadening 134, lies pressed in the position of the unlocking and locking element shown in FIG. 25*a* against a surface side of the hinge arm or tang 115 and clamps said arm or tang fast in the recess 123 by wedge action. The different positions of the unlocking and locking element 130 are indicated by a, for instance, triangular mark 135 on the unlocking and locking element 130, this mark 135 corresponding to marks on the top side 105' of the adjustment body 105 which are designated by "S", "Z" and "A" in FIGS. 24*a*–24*b* and 25*a*–25*c*, the hoop 124 which serves as detent element coming out of engagement in the position "A" with the depressions 128 of the hinge arm or tang 115, while in the position "Z" the wire hoop 124 is swung by its own elasticity so far into the recess 123 that the wire hoop 124 can engage with spring action in one of the depressions 128, while in position "S" the additional locking of the hinge arm 115 in the recess 123 is effected by the radial extension 133. In this connection, it is assumed that the thickness of the radial extension, in a position of the unlocking and locking element corresponding to FIG. 25*a*, increases in the direction towards the end of the hinge arm 115 which is rolled up to form the knuckle.

Figure 22B:
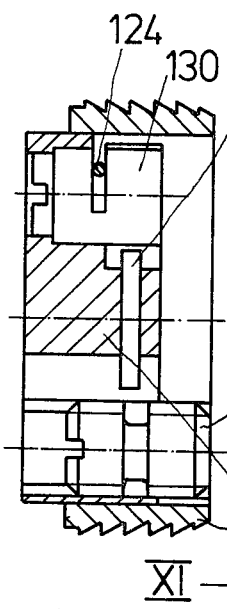
Figure 22A:
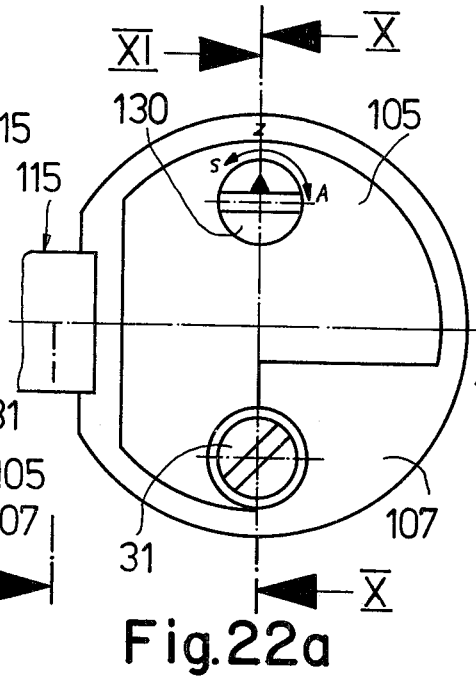
Figure 22C:
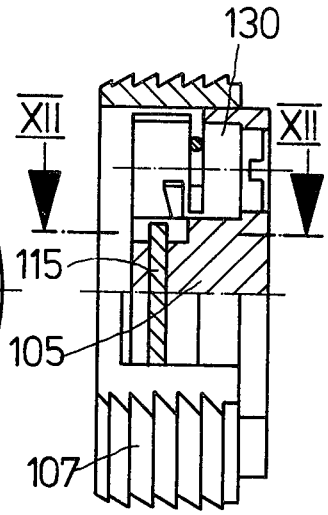
Figure 22D:
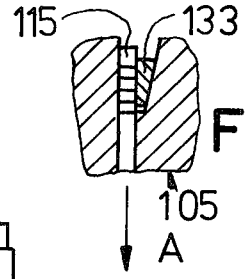

However, it may be more advisable to develop the radial extension 133 in such a manner that its thickness (in the circumferential direction of the unlocking and locking element) in a position of the unlocking and locking element corresponding to FIG. 25*a*, i.e. upon additional anchoring of the hinge arm 115 in the recess 123 by the radial extension 123, decreases towards the end which is rolled up to form the knuckle, as shown in FIG. 22*d* for this modified embodiment. In this case, the positions "A" and "S" would be interchanged. This modification has the advantage that, in the case of forces exerted in the direction indicated by the arrow A of FIG. 26 on the hinge arm 115, any slight movement of this arm in the direction indicated by the arrow A would further increase the locking action by the extension 133.

The adjustable displacement of the adjustment body 105 in the intermediate body 107 is effected again by means of the adjustment screw 31, which has been described already in connection with FIGS. 1 to 15 and which is arranged in semicircular recesses 32 and 33 of the adjustment body 105 and the intermediate body 107, the outwardly open slot 125 of the adjustment body 105 being closed by the intermediate body 107 so that, after the introduction of the adjustment body 105 into the intermediate body 107, the wire hoop 124 which serves as detent element can no longer drop out of said slot 125, and at the same time, furthermore, the unlocking and locking element 130 is held firmly in the bore 129 by the wire hoop 124 which engages into the circumferential groove 131. All parts of the adjustment body 105 are held together thus in unlosable fashion in a particularly simple manner.

The assembling of the hinge parts is effected approximately in the sequence which can be noted from FIG. 16. First of all, the unlocking and locking element is so introduced into the bore hole 129 from the rear side of the adjustment body 105, not visible in FIG. 16, that the end of this unlocking and locking element 130 which is provided with the slot 132 and is somewhat reduced in cross section lies in a section of the bore hole 129 on the front side 105' of the adjustment body 105 which has a reduced cross section as compared with the rest of the bore hole 129 and thus produces a well-defined position for the unlocking and locking element 130 in the bore hole 129, so as to facilitate the assembly. Thereupon, the wire hoop 124 is pushed into the slot 125 in such a manner that the bent second end of the wire hoop lies in the bore hole 127 while the bent first end of the wire hoop 124, depending on the position of the unlocking and locking element 130, lies in the recess 126 or extends beyond said recess into the recess 123 of the strengthener (sic).

The adjustment body 105 as well as the adjustment screw 31 are now introduced into the intermediate body 107, as has been described above in connection with FIGS. 1 to 15, in the manner that the recess 123 in the adjustment body 105 coincides with an opening 142 on the circumferential surface of the intermediate body 107. This opening 142, which serves for the passage of the hinge arm 115 through the intermediate body 107 into the adjustment body 105, is of rectangular cross section and is adapted in its dimensions perpendicular to the surface of the side wall of the cabinet to the desired range of adjustment in this direction.

The assembling of the hinge part 110 to the hinge arm or tang 115 is effected in the manner which has already been described for the hinge part 10 and the hinge arm 15 in connection with FIGS. 1 to 15. The mounting of the hinge on the cabinet is effected in the manner that the intermediate body 107, together with the adjustment body 105, is so anchored in a bore hole 143 in the side wall of the cabinet which is open towards the end surface 104 that the recess 123 as well as the opening 142 are directed towards the end surface 104 and the longitudinal edges of the rectangular recess 123 extend parallel to the front edges of the side wall 101 of the cabinet The anchoring of the intermediate body 107 in the bore hole 143 is effected in the same manner as has been described in the case of the intermediate body 7.

The final mounting on the cabinet 101 of the cabinet door 102 which has been premounted with the hinge part 110 and with the hinge arm 115 is then effected by pushing the free end of the hinge arm 115 through opening 142 into recess 123 until the single hinge pin 112 has assumed the required position with respect to the side wall 101 of the cabinet or the free, first bent end of the wire hoop 124 has engaged in a sawtooth depression 128. The mark 135 of the unlocking and locking element 130 in this connection points to the position "Z" (FIG. 25*b*). After the engagement of the wire hoop 124 in a depression 128, the locking element 130 in the embodiment shown (with the exception of the embodiment in accordance with FIG. 22*d*) is turned in clockwise direction so that mark 31 points to the position "S" whereby the hinge arm 115 is additionally clamped in the recess 123, in the manner described above.

If the furniture door 102 is to be removed again for any reason from the cabinet or from the side wall (101) of the cabinet, the locking element 130 is so turned in clockwise direction that the mark 135 points to the position "A". The hinge arm 115 can then be pulled, unimpeded, out of the recess 123 of the adjustment body 105.

The embodiment shown in FIGS. 16 to 27 permits adjustment of the hinge arm 115 relative to the side wall 101 of the cabinet in two directions in space, namely in the direction parallel to the surface sides of the side wall 101 of the cabinet by pushing the hinge arm 115 to a greater or lesser depth into the recess 123 and in the direction perpendicular to the surface sides of the side wall 101 of the cabinet by means of the adjustment screw 31.

FIGS. 28 to 33 show an embodiment of the hinge of the invention in which the pivot system is formed of four hinge pins 214, 214', 218 and 218' and of two hinge levers 217 and 217'.

In these figures, 101 is again a side wall of a cabinet of which, for purposes of simplification, merely the upper left-hand hinge-side corner has been shown. On this side wall 101 of the cabinet the cabinet door 102 is to be swingably fastened by means of a hinge in such a manner that this door, when closed, rests with its inner surface 203 against the edge surface 104 of the side wall of the cabinet (FIG. 31). The hinge corresponds, with respect to the first hinge part to be fastened in the recess 143 of the side wall 101 of the cabinet (adjustment body 105, intermediate body 107 and associated parts), to the hinge which was described in connection with FIGS. 16 to 27 and differs from said abovedescribed embodiment essentially only by the second hinge part which is to be fastened to the cabinet door 102 and which has the shape of a hinge housing 210 which is substantially cylindrical and has a recess 211. In the region of the recess the hinge housing 210 is provided with boreholes 212 and 213 for hinge pins 214 and 214' which serve for the pivoting of hinge levers 217 and 217' to the hinge housing 210. At the other end, the hinge levers 217 and 217' are pivoted by hinge pins 218 and 218' respectively to the arms 219, and 219' respectively of a hinge support 220, the hinge pins 218 and 218' being held in boreholes of the arms 219 and 219' and the arms 219 and 219' which are arranged parallel to each other receiving the hinge levers 217 and 217' at least partially between them. The hinge pins 214, 214', 218 and 218' together with the hinge levers 217 and 217' form a known articulation system with four articulation points.

The hinge support 20 consists essentially of the flat hinge arm 115 which is connected via a connecting piece 220 which is also flat and the surface sides of which extend parallel to the hinge pins 214, 214', 218 and 218' with an arm 21 which extends parallel to the hinge arm 115 so as to form a fork-shaped body. On the arm 221 there are then formed the arms 219 and 219', the arm 221 having an extension 221' at its free end facing away from the connecting piece 222. The hinge support 220 can be made of sheet metal in a particularly simple manner by stamping and then bending. The hinge arm 115 can be fastened adjustably in the same manner in the recess 123 of the adjustment body 105 and, via said adjustment body, to the intermediate body 107 as has been described in connection with FIGS. 16 to 25*a*–25*c*, in this case again the wire hoop 124 which engages into a depression 128 creates a provisional anchoring of the hinge arm 115 and the hinge support 220 on the adjustment body 105, while the final locking is effected by the clamping of the hinge arm 115 in the recess 123 by means of the radial extension 133, in the manner described above.

The fastening of the hinge support 220 to the hinge housing 210 is effected in the manner that the hinge arms 217 and 217' are pivoted to the hinge housing 210 by means of the hinge pins 214 and 214' which engage in the boreholes 212 and 213 respectively. Thereupon, the other end of the hinge arms 217 and 217' respectively is connected in similar manner to the hinge support 220 by the hinge pins 218 and 218'; the hinge levers 217 and 217', which are bent out of sheet metal and arranged on edge, surround the hinge pins 214, 214', 218 and 218' by their ends which are rolled up to form knuckles.

For the pivoting of the cabinet door 102 to the side wall 101 of the cabinet, the hinge housing 210 is anchored in suitable manner in a borehole 243 provided on the inner surface of the cabinet door 102, for instance by means of barb-like ribs formed on the circumference of the hinge housing 210, by inclined screws, or by bonding, etc. In the borehole 143 which is open towards the end surface 104 the intermediate body 107, premounted with the adjustment body 105, the wire hoop 124, and the unlocking and locking element 130, is so anchored that the recess 123 as well as the opening 142 is directed towards the edge side 104 and the longitudinal edges of the rectangular recess 123 extend parallel to the front edges of the side wall 101 of the cabinet.

The final mounting of the cabinet door 102 which has been premounted with the hinge housing 210 and with the hinge support 220 on the cabinet or the cabinet side wall 101 then takes place in the manner described, by inserting the hinge arm 115 into the recess 123.

For the additional securing of the hinge support 220 to the adjustment body 105, a threaded bore 246 is provided in said adjustment body 105 for a holding or securing screw 247 which engages into the laterally open slot 248 on the extension 221' of the arm 221, which, when the hinge arm 115 is introduced into the recess 123, lies against the top side 105' of the adjustment body 105. Through the laterally open slot 248 it is possible to premount the securing screw in the adjustment body, the extension 221' of the hinge support 220 being pushed, upon the insertion of the hinge arm 115, below the head of the securing screw 247 which has been premounted or screwed into the threaded borehole 246. Thereupon the securing screw is tightened so that its head is pressed against the extension 221'. The length of the slot 248 corresponds to the desired range of adjustment of the hinge support 220 or of the hinge arm 115 in the direction of the recess 123 and in the direction perpendicular to the edge surface 104 of the side wall 101 of the cabinet respectively.

FIGS. 34 to 41 show a modification of the hinge of FIGS. 1 to 15. In this hinge, the hinge part 301, which is to be fastened to the cabinet door 310, is formed of a plate-shaped connecting web 302 and by rounded extensions 303 and 304 having the shape of cylinders or partial cylinders which protrude laterally and are developed on both ends of said connecting web. The extensions 303 and 304 have blind boreholes 305 and 306 which are closed towards both ends of the hinge part 301 and are accessible at the rear or at the fastening surface 307 of the hinge part 301 through a slot 308 which at the same time also extends through the connecting web 302 and serves for the lateral introduction of the single hinge pin 309 into the hinge part 301, the hinge pin 309 having both its ends in the blind holes 305 and 306.

The embodiment of the hinge of the invention which is shown in FIGS. 34 to 41 also serves for the attachment of so-called recessed cabinet doors 310 to the side wall 311 of a cabinet 312, i.e., for the attachment of cabinet doors which in closed position swing into the door openings formed by the cabinet side walls and by the cabinet top and bottom as shown in FIG. 39.

For this purpose the hinge part 301, similar to the hinge part 10 of FIG. 1, is held by its fastening flange 307 against the outer surface of the cabinet door 310, for instance with screws which are passed from the inner surface of the door through boreholes in the cabinet door 310 and engage into threaded boreholes 313 and 314 on the fastening surface 307.

For the articulated connection of the hinge part 301 and the cabinet door 310 to the cabinet 312 there is used a hinge arm 315 which at its one end has an approximately cylindrical bearing part 316. The hinge arm 315 is tang-shaped or made of flat material, the bearing part 316 extending with its cylindrical axis 317 parallel to the larger surface dimensions of the hinge arm 315. The bearing part 316 has a bearing hole 318 which coincides with the cylinder axis 317 and which is open, over a laterally open longitudinal slot 319, towards the periphery of the bearing part 316, said longitudinal slot 319 being located on a part of the circumferential surface of the bearing part 316 facing the hinge arm, laterally of the connecting point between the hinge arm 315 and the bearing part 316.

For the swingable attachment of the hinge arm 315 to the hinge part 301 which is premounted with the hinge pin 309, the bearing part 316 is, a shown in FIG. 35, so inserted from the side, i.e., in the direction indicated by the arrow B of FIG. 35, into the fork-shaped recess 320 formed by the extensions 303 and 304 and the connection web 302 that the hinge pin 309 passes, via the longitudinal slot 319, into the bearing borehole 318, the recess 320 being adapted in its width, by suitable selection of the distance between the extensions 303 and 304, to the height of the bearing part 316. Upon this placing of the bearing part over the hinge pin 309, the bearing part 316 is so arranged that the longitudinal slot 319, as well as the connecting web and the slot 308, are on the same side of the hinge arm 315.

After the bearing part 316 has been placed over the hinge pin 319, the hinge parts assume the position with respect to each other which is shown in FIG. 36, the arm being then locked against accidentally falling out of the hinge part 301 by swinging it in the direction indicated by the arrow A in FIG. 36, i.e. by swinging it in clockwise direction, as seen in this figure. In the case of the embodiment shown, this swinging of the hinge arm 315 is limited to an angle of 180°, the end position of this swinging motion being shown in FIG. 37. In this end position, one surface 321 of the hinge arm 315 rests against a stop surface 322 of the hinge part 301 and the longitudinal slot 319 and the slot 308 are on different sides of the hinge arm 315. As furthermore shown in FIGS. 40 and 41, the circumferential surface of the bearing part 316 forms, outside the longitudinal slot 319, a first slide surface 323 which cooperates with second slide surfaces 324 and 325, provided in the recess 320 of the hinge part 301 on the longitudinal sides of the slot 308 and adapted in shape to the cylindrical shape of the bearing part 316, in such a manner that it is not possible for the bearing part 316 to drop out of the hinge part 301 as long as both slide surfaces 324 and 325, which in the embodiment shown are arranged about 60° apart around the hinge pin 309, are in engagement with the slide surface 323. This means that the cabinet door 312 attached to the hinge could be swung from the closed position shown in FIG. 40 by almost 180° in the direction shown by the arrow C in FIG. 40 before the dropping of the bearing part 316 out of the hinge part 301 need be feared. This possible angle of swing is however not utilized in actual practice, since the cabinet door 310 has already previously reached its full open position.

The fastening of the hinge arm 315 to the cabinet side wall 311 and to the cabinet 312 is effected, in this embodiment also, again by means of the adjustment body 7, which is held displaceably in the intermediate body 7, i.e. in the same manner as has been described for the hinge arm 315 in connection with FIGS. 1 to 15. For this attachment to the cabinet side wall 311, the hinge arm 315 is inserted into the recess 20 of the adjustment body 5 and engages there, with one of its recesses or grooves 24 which are provided on the longitudinal sides of the hinge arm or tang 315, in the wire hoop 21, an additional clamping of the hinge arm 315 in the recess 20 then taking place by a suitable turning of the unlocking and locking element 26.

In this embodiment shown in FIGS. 34 to 41 the locking and unlocking element 26 also again has three positions, which are designated "S", "Z" and "A", and of which positions "S" corresponds to the position of the unlocking and locking element 26 in which the eccentric surface 29 is pressed against the hinge arm 315, while in the positions "Z" and "A" only the wire hoop 21 extends into the slot-shaped recess 20 and is lifted out of the recess 20 by the locking and unlocking element 26 respectively.

Since the hinge part 301 as well as the bearing part 316 are visible when the cabinet door 310 is closed, the hinge part 301 in particular is so developed that it is adapted in its outer shape to the style of the cabinet in question. In the embodiment shown in the drawing, as smooth as possible an outer appearance for the hinge parts visible when the cabinet door 310 is closed has been desired, so that the hinge part 301, and in this connection particularly the extensions 303 and 304 of said hinge part, are adapted in their width as well as in their curvature on the side facing away from the cabinet door 310 to the cross section of the bearing part 310, so that a smooth surface is obtained for the hinge parts, and thereby furthermore edges, on which dust could deposit, are avoided.

The hinge parts are preferably made of metal in the case of the hinge of the present invention. However, it is also possible to use plastic insofar as this is possible from a standpoint of the load to which the hinge parts are subjected upon the swinging or the attachment of a cabinet door.

The invention has been explained above with reference to illustrative examples. It is obvious that modifications thereof are possible without thereby going beyond the inventive concept.

What is claimed is:

1. A hinge for articulated connection of two components comprising a first hinge part, a second hinge part and a hinge arm pivotally mounted on said second hinge part, said second hinge part having means operable to fix said second hinge part to one of said components and said first hinge part having an outer anchoring portion and an inner portion, said outer portion being operable to anchor said first hinge part in a bore hole of the other of said component and said inner portion being disposed within a complementary opening in said outer portion and being adjustably displaceable within said outer portion for positioning along an axis perpendicular to the surface of the component within which said first hinge part is mounted, said inner portion having a recess operable to receive said hinge arm and locking means operable to retain said hinge arm in said recess.

2. A hinge according to claim 1 wherein said inner portion is a partial cylinder having a cross-section of a partial circular sector.

3. A hinge according to claim 2 wherein said inner portion has a cross-section of a circular sector of approximately 270°.

4. A hinge according to claim 1 including first screw means operable to adjustably displace said inner portion relative to said outer portion.

5. A hinge according to claim 1 wherein said inner portion is a partial cylinder having a cross-section of a partial circular sector and said outer portion has an inner opening complementing said inner portion, said inner and outer portion having complementing depressions together defining a circular screw opening, one of said depressions being threaded and the other of said depressions having screw retaining means, and screw means threaded in said circular screw opening and operable to adjustably displace said inner portion relative to said outer portion.

6. A hinge according to claim 5 wherein said inner portion is a partial cylinder having a cross-section of a circular sector of 270°.

7. A hinge according to claim 1 wherein said locking means includes detent means and said hinge arm carries at least one engagement surface positioned for engagement by said detent means.

8. A hinge according to claim 1 wherein said hinge arm is a flat strip of rectangular cross-section and said recess has a rectangular cross-section complementing the cross-section of said hinge arm.

9. A hinge according to claim 8 wherein said locking means include detent means and said hinge arm carries at least one notch positioned for engagement by said detent means on at least one edge.

10. A hinge according to claim 7 including means operable to disengage said detent means from said hinge arm.

11. A hinge according to claim 10 wherein said detent disengagement means includes a rotatable shaft disposed in said inner portion of said first hinge arm and defining an eccentric surface operable upon rotation of said shaft to move said detent means between engagement position within said hinge arm receiving recess and disengagement position.

12. A hinge according to claim 11 wherein said shaft is rotatable about an axis perpendicular to the surface of the component in which said first hinge part is mounted.

13. A hinge according to claim 11 wherein the peripheral surface of said shaft is provided with a groove disposed for engagement of said detent means, the root of said groove defining said eccentric surface.

14. A hinge according to claim 11 wherein said detent means is a wire spring said inner portion of said first hinge member has a circumferentially disposed slot communicating with said hinge arm receiving recess and operable to receive said wire spring, and wherein said shaft is provided with spring engagement means operable to retain said shaft in said inner portion throughout full rotation of said shaft.

15. A hinge according to claim 11 wherein said rotable shaft includes means for further anchoring said hinge arm in said recess, when said detent means are moved to said engagement position.

16. A hinge according to claim 15 wherein said further anchoring means is a second outer eccentric surface on said rotatable shaft.

17. A hinge according to claim 16 wherein said eccentric surface is formed by a wall portion extending sidewards from the peripheral surface of said shaft and being wedge-shaped in circumferential direction of said shaft, the one surface of said wall portion abutting one surface of said hinge arm and the other surface of said wall portion abutting a side face of said recess receiving said hinge arm.

18. A hinge according to claim 1 wherein said recess is positioned on the front surface of said inner portion of said first hinge part which surface is parallel to the surface of the compoent in which said first hinge part is mounted.

19. A hinge according to claim 1 wherein said recess is positioned in said inner portion perpendicular to the front surface of said first hinge part which surface is parallel to the surface of the component in which said first hinge part is mounted, said outer portion having an opening or recess defined wherein for passage of said hinge arm.

20. A hinge according to claim 19 wherein said locking means include detent means and said hinge arm carries at least one notch positioned for engagement by said detent means, said detent means including a curved wire spring having a hooked extention thereon operable to engage said notch.

21. A hinge according to claim 1 wherein said hinge arm is pivotally mounted on said second hinge part through a plurality of cooperating hinge levers and associated hinge pins.

22. A hinge according to claim 1 wherein said second hinge part has pin holding means and a concave sliding surface and said hinge arm has a base defining a substantially cylindrical surface complementing the concave sliding surface of said second hinge part, said base having a hinge pin bearing concentrically disposed relative to said cylindrical surface and through which said hinge arm is pivotally mounted on said second hinge part and said base further having a channel running parallel to the main plane of the hinge arm and communicating with said bearing and the cylindrical surface of the base, said channel and complementing surfaces being operable to permit, in a first orientation, introduction of said hinge pin into said bearing through said channel but upon rotation of said hinge arm and passage of said cylindrical surface over said concave surface, retention in pivotable relationship of said hinge arm on said second hinge part in all other orientations within 180° of said first orientation.

23. A hinge according to claim 22 wherein the pin holding means of said second hinge part includes a pair of pinholding extensions and a slot operable to receive the hinge pin, said slot running from said surface of the second hinge part upon which it is mounted to the interior of said extensions so as to define within said extensions blind bearings for said pin.

* * * * *